US005901525A

United States Patent [19]

Doeringer et al.

[11] Patent Number: 5,901,525

[45] Date of Patent: May 11, 1999

[54] ELEVATED BASE FOR COLUMN SUPPORT

[75] Inventors: Henry Peter Doeringer, West Springfield, Mass.; Robert Louis Consolini, Canaan, Conn.; Eckert Lewis, Belize, Belize

[73] Assignee: Robert L. Consolini, Canaan, Conn.

[21] Appl. No.: 09/191,814

[22] Filed: Nov. 13, 1998

[51] Int. Cl.[6] ..... E04C 3/30

[52] U.S. Cl. ..... 52/736.4; 52/737.3; 52/737.5; 52/737.6; 52/731.6; 52/98; 52/298; 52/169.13; 248/519

[58] Field of Search ..... 52/155, 159, 165, 52/295, 296, 300, 301, 297, 298, 720.1, 726.4, 731.4, 732.3, 716.4, 737.3, 737.5, 738.1, 736.1, 98, 169.13, 100, 704, 705, 708; 248/156, 530, 532, 519, 188.1, 188.2, 218.4, 219.3

[56] References Cited

U.S. PATENT DOCUMENTS

| | | |
|---|---|---|
| 4,048,776 | 9/1977 | Sato . |
| 4,644,713 | 2/1987 | Lehman . |
| 4,972,642 | 11/1990 | Strobl, Jr. . |
| 5,090,165 | 2/1992 | Kenny . |
| 5,456,441 | 10/1995 | Callies . |
| 5,568,909 | 10/1996 | Timko . |

*Primary Examiner*—Christopher Kent
*Assistant Examiner*—Yvonne Horton-Richardson
*Attorney, Agent, or Firm*—Edward Gray

[57] ABSTRACT

An elevated column base for supporting a wood column subjected to high mechanical loads and protecting the column lowermost portion from rot and other deterioration due to exposure to a tropical environment. The column base includes a stanchion, a diaphragm, and a cap, each monolithically molded from a thermoplastic. A first embodiment of the stanchion adapted for a 6×6 or 8×8 column includes a solid base portion with a cavity which is filled with concrete and plugged with the diaphragm. The stanchion has two pairs of side walls attached to the base portion. Opposed gussets attached to the upper portions of one pair stiffen the side walls against transverse loads. Most of the load carried by the wood column is borne by the concrete and by two horizontal bolts. The diaphragm acts to spread the load force to the base portion and side walls. The load on the diaphragm acts to create a seal against moisture entering the cavity. A second embodiment of the stanchion adapted for a 4×4 column does not include gussets. The cap has four lateral faces fitting closely over the stanchion side walls, and a top face with a square aperture formed by four flexible web portions pressing against the wood column. After the column lowermost portion is secured within the stanchion by the bolts, the cap is slid downwardly until the ends of slots in the lateral faces contact the bolts. Each cap bottom corner edge and trough then bound an aperture through which water collected above the diaphragm can drain.

29 Claims, 9 Drawing Sheets

172
172L
164
140D
138T
134I
144E
138
148,148E
134T
168
160
130
134
152
170
166
144
162
132T
132I
140C
136T
132
146E
142E
136
140B
142
150
1C
134B
146
140A
141A
141C
132B
136B
138B
1C
141B
120
20
122
66B
1D
1D
124
106E 90E
106I
188
94
110
66A
90I
106
92
114
98
90
190
82
112
1A
108
22
104
88I
104E
118
88
104I
184
96H
96
100
80
180
42P
42
88E
183
80H
186
84
102
96V
80V
32
182
24
68B
34C
30U
42P
34A
28
56
56
26U
62
30
30L
26
34B
60E
26L
68A
60U
60
60L

ELEVATED BASE FOR COLUMN SUPPORT

BACKGROUND OF THE INVENTION

1. Field of the Invention

The present invention relates to building construction supports, and more particularly, to an elevated base for supporting a wood column and protecting the column lowermost portion from rot and other deterioration due to exposure to moisture, heat, fungus, and parasites such as wood-boring insects.

2. Description of the Related Art

Wood has been a traditional material in the world's tropic and two temperate zones, especially where lumber is an indigenous product which is easily available locally. But in tropical regions such as Central and South America, Africa, and Southeast Asia, wooden structures are susceptible to deterioration from the effects of humidity, heat and ultraviolet radiation. Usually the lowermost portion (i.e., the base portion) of vertical wood columns which support a building is the most vulnerable structural element because it is most exposed to moisture. In buildings having side walls as in the temperate zones, water accumulates through seepage; in buildings on stilts as in the tropics, support column base portions are directly exposed repeatedly as rain water accumulates and evaporates. Therefore, the lifetime of a building depends largely upon how long its columns endure. Typically, the life of a wood column in the tropics is limited to about 20 years, with failure due to rot usually occurring where the column intersects the earth. But where rotting has been prevented, e.g., by placing a building on a solid foundation of stone, the building can last for hundreds of years. Concrete block construction is about 30–45 percent more expensive than wood construction. The cost spread depends both on the import tariff on bulk cement in a particular country and on the transportation cost of bagged cement or concrete blocks, which is particularly expensive if an oil refinery is not available for processing crude oil into gasoline for the truckers. Houses built in the tropics with concrete blocks can last about twice as long as wooden houses provided prudent construction techniques are used, e.g., coating exterior walls with stucco. In the late 1940's and 1950's, concrete blocks were extensively used. However, shoddy construction then has resulted in houses being abandoned now due to rapid deterioration. Although building practices in the tropics have been improved in recent years, particularly through the use of poured concrete instead of concrete blocks, the feasibility and affordability of new housing in a region often are largely determined not by local builders but by the concrete and trucking industries. Wood, although often in plentiful supply locally and offering the potential advantages of decentralized production and distribution by saw mills in forests and lumber yards in towns, remains a bad investment compared to concrete.

There is thus an urgent need, especially in the tropics, for a method of building houses from lumber available locally which can produce houses which will last at least as long as those built using concrete. The problems in achieving such longevity are preventing the wood support column base portion from rotting and providing a stanchion-type base to enclose and support the base portion which can withstand the high up-loads, down-loads and transverse loads to which the column would be subjected during hurricanes.

Bases to support wood and steel columns in the construction of buildings, and post bases used in the construction of wooden decks, porches and fences are known in the art. U.S. Pat. No. 5,568,909 ("'909") to R. J. Timko discloses a mounting bracket for housing a wood post installed on a flat surface. The bracket includes a square tube having four side walls and open upper and lower ends, dimensioned to receive a wood post having a nominal four inch-by-four inch ("4×4") cross-section. The tube lower end is attached to a square base portion having a hole at each comer to receive a concrete anchor bolt, lag bolt or wood screw. The bolts or screws secure the base plate to a concrete porch, wooden deck or flat roof. The post is secured within the tube by nails each received through a hole in a side wall and driven into the post. An aperture in one side wall extending upwardly from the lower tube end allows water that enters the tube to drain.

U.S. Pat. No. 5,456,441 ("'441") to G. Callies discloses a post base for supporting a wood post relative to a concrete footing in which a seat member which receives the wood post bottom end is rotatably adjustable relative to an anchor member embedded and immovably propositioned in a poured concrete footing. The seat member has a base and two side flanges integrally formed with and generally orthogonal to the base. The base receives the post bottom end and the flanges engage two opposed post sides. The post is secured to the seat member by nails each received through a hole in a side flange and driven into the post. The base is rotatably attached to three expanded portions of the anchor member, two of which capture the base top and bottom sides, with the third forming a collar coinciding with a center opening in the base.

U.S. Pat. No. 5,090,165 ("'165") to L. D. Kenny discloses a molded plastic sleeve (or boot) which fits over the circumferential base of a wood post or pole embedded in the ground. The plastic sleeve forms a barrier intended to retard the decaying or rotting of the wood. The base of the post or pole must be reduced to fit into an opening in the sleeve. An umbrella-like rim at the top of the sleeve deflects excess moisture which may run down the post away from the sleeve. The sleeve has two vents each covered by a molded hood, extending from the sleeve base to several inches above the ground, which provide expansion areas for freezing should moisture accumulate in the sleeve.

U.S. Pat. No. 4,972,642 ("'642") to F. P. Strobl, Jr. provides a foot for supporting a wood post at the bottom of a hole in the ground which typically extends below the frost line. The plastic foot is monolithically molded and has a dish-shaped bottom wall configured to be supported by the earth at the bottom of the hole. Radial rib structures on the bottom wall distribute loads over the entire wall.

U.S. Pat. No. 4,644,713 ("'713") to J. F. Lehman is directed to a post anchor device to rapidly position and support a post in the ground. The device has a tubular ground engaging portion with a tapered end that is driven into the ground, and a post receiving portion with an upstanding bracket into which the post is received and secured by fasteners.

U.S. Pat. No. 4,048,776 ("'776") to K. Sato discloses a steel base plate for connecting a steel column of a steel structure to a concrete foundation. The base plate is formed by molding or die-forging without welding any ribs thereto to eliminate the risk of generating welding strain. A projection extending from a planar bottom portion provides a top surface whose shape is substantially identical to the cross-section of a column to be supported by the base plate. Smoothly curved sidewall portions at the junctions between the projection and bottom portion are intended to eliminate stress concentration. Holes in the base plate allow anchor bolts to extend therethrough.

None of these references addresses the problem of protecting a wood column from deterioration while also providing support against high mechanical loading. The '909 mounting bracket is adapted for housing a wood post installed on a flat deck so that the post lower portion is well away from the bare earth. The seat member of the '441 post base is above ground but no provision is made for protecting the post lower end from the environment. The '642 plastic foot supports a wood post in a hole in the ground whose lower portion is unprotected from contact with the earth. The '165 sleeve forms a barrier which protects the base of a wood post or pole buried in the earth, but does not provide support against loading. The '713 post anchor provides neither environmental protection nor structural support. The '776 column base member has high mechanical strength and rigidity, but houses a steel column in a steel structure rather than a wood column in a wooden structure.

OBJECTS OF THE INVENTION

In view of the limitations of the related art, it is an object of the present invention to provide a column base which protects the base portion of a wood column from moisture, heat, fungus and wood parasites.

Another object of the invention is to provide a column base which can not only support the weight carried by a wood column, but which can also sustain the stresses imposed by Category 4 hurricanes with winds gusting up to 120 mph.

A further object of the invention is to provide a column base which is simple, reliable and inexpensive to manufacture.

Yet another object of the invention is to provide a column base which is easily aligned when embedded in concrete and which facilitates installation and alignment of a wood column.

SUMMARY OF THE INVENTION

These and other objects are achieved by the present invention which in a first aspect provides a column base for housing and supporting the lowermost portion of a wood column. The column base includes a stanchion having a solid base portion with a horizontal lower surface and a horizontal upper surface. The lower and upper surfaces each have an aperture and the base portion has a cavity extending between the apertures. The stanchion further includes a flange with an aperture coinciding with the aperture in the lower surface. The flange is rigidly attached to the lower surface of the base portion. The stanchion further includes a first pair of opposed vertical side walls and a second pair of opposed vertical side walls each orthogonal to the first pair. The side walls are rigidly attached to the base portion upper surface.

The column base further includes a diaphragm having a central portion circumscribed by a relatively thin lip. The central portion has a convex upper surface and a planar lower surface, and the lip has planar upper and lower surfaces. The central portion is closely received within the aperture in the base portion upper surface, and the lip is closely received between the aperture and side walls. The flange aperture and base portion cavity are filled with poured concrete up to the aperture in the base portion upper surface less the thickness of the diaphragm central portion.

The column base further includes a cap having a first pair of opposed lateral faces and a second pair of opposed lateral faces each orthogonal to the first pair. Each contiguous pair of orthogonal faces is rigidly attached along a common edge. Each face has parallel top and bottom edges, with each contiguous pair of bottom edges determining a bottom corner edge. The cap further includes a top face having four independently flexible web portions. Each web portion is rigidly attached along the top edge of a lateral face. The web portions determine an aperture through which the wood column is closely and slidably received. The stanchion side walls are closely received within the cap lateral faces when the cap is slid downwardly.

In a second aspect the invention provides a column base for housing and supporting the lowermost portion of a wood column. The column base includes a stanchion having a solid base portion with a first pair of opposed vertical faces and a second pair of opposed vertical faces each orthogonal to the first pair. Each pair of mutually orthogonal faces is contiguous along a vertical edge, and each face has horizontal lower and upper edges. The base portion has a lower surface bounded by the face lower edges, and an upper surface bounded by the face upper edges. The lower and upper surfaces each have an aperture. The base portion has a cavity extending between the apertures. The perimeter of the lower surface aperture and the face lower edges bound a lower surface peripheral region, and the perimeter of the upper surface aperture and the face upper edges bound an upper surface peripheral region. Each pair of mutually orthogonal upper edges determines a corner, with a portion of the upper surface peripheral region proximate to the corner having a trough beveled outwardly. Portions of the upper surface peripheral region exterior to the troughs are planar. The faces are circumscribed by a horizontal concrete line at a predetermined distance below the base portion upper surface. The stanchion further includes a flange with opposed upper and lower surfaces orthogonal to the base portion faces. The flange has an aperture coinciding with the aperture in the base portion lower surface. The flange upper surface is rigidly attached to the lower surface peripheral region of the base portion. The stanchion further includes a first pair of opposed vertical side walls each having a lower end rigidly attached and orthogonal to a planar portion of the upper surface peripheral region. Each side wall has an upper portion terminating in an upper end, with each upper portion having a planar exterior surface. The thickness of each side wall tapers decreasingly from the lower end to the upper end. The stanchion further includes a second pair of opposed vertical side walls, each orthogonal to the first pair. Each side wall has a lower end rigidly attached and orthogonal to a planar portion of the upper surface peripheral region, and an upper portion terminating in an upper end. The thickness of each side wall tapers decreasingly from the lower end to the upper end. The lower ends of each pair of adjacent side walls are separated by a gap, the gap and upper surface peripheral region proximate to the gap determining a trough.

The column base further includes a diaphragm having a circular central portion circumscribed by a relatively thin lip. The central portion has a convex upper surface and a planar lower surface, and the lip has planar upper and lower surfaces. The central portion is closely received within the aperture in the base portion upper surface, and the lip is closely received between the aperture and side walls.

The column base further includes a cap having a first pair of opposed lateral faces and a second pair of opposed lateral faces each orthogonal to the first pair. Each contiguous pair of orthogonal faces is rigidly attached along a common edge. Each face has parallel top and bottom edges, with each contiguous pair of bottom edges determining a bottom corner edge. The cap further includes a top face having four independently flexible web portions. Each web portion is rigidly attached along the top edge of a lateral face. The web portions determine an aperture through which the wood column is closely and slidably received. The stanchion side walls are closely received within the cap lateral faces when the cap is slid downwardly until the cap lateral face bottom edges are at a common predetermined distance from the concrete line.

The column base further includes: means for stiffening the side walls against transverse loads; means for stiffening the base portion against up-loads and down-loads; means for minimizing moisture seepage into the base portion; means for draining water accumulated above the diaphragm; and means for protecting the lowermost portion of the wood column from moisture, heat, fungus, and wood parasites. The means for stiffening the side walls includes a pair of opposed downwardly tapering gussets. Each gusset has an upper edge coinciding with the upper end of the upper portion of one of the first pair of side walls, and is rigidly attached to the exterior surface of the upper portion. The combined thickness along the length of each gusset and attached side wall upper portion is about constant and about equal to the thickness of the side wall lower end. The means for stiffening the side walls further includes at least one shim interposed between a side wall upper portion and the wood column. The means for stiffening the base portion includes the flange aperture and base portion cavity being filled with poured concrete up to the aperture in the base portion upper surface less the thickness of the diaphragm central portion. The means for minimizing moisture seepage includes the diaphragm central portion inserted within the aperture in the base portion upper surface and resting on the concrete so that the weight carried by the wood column compresses the diaphragm lip against the upper surface peripheral region. The means for draining water includes four apertures each determined by a separation between a trough and a cap face bottom corner edge. The means for protecting the lowermost portion of the wood column includes immersion of the base portion in concrete to a depth such that the concrete surface exterior to the base portion is at the concrete line, with each cap face bottom corner edge and proximate trough separated to form an aperture. The means for protecting the lowermost portion of the wood column further includes the web portions in pressing contact with the wood column.

In a third aspect the invention provides a column base for housing and supporting the lowermost portion of a wood column with a square cross-section. The column base includes a stanchion having a solid base portion with a first pair of opposed vertical faces and a second pair of opposed vertical faces each orthogonal to the first pair. Each pair of mutually orthogonal faces is contiguous along a vertical edge, and each face has horizontal lower and upper edges. The base portion has a lower surface bounded by the face lower edges, and an upper surface bounded by the face upper edges. The lower surface has a square aperture with radiused vertices, and the upper surface has a circular aperture. The base portion has a symmetrically disposed cavity tapering inwardly from the square aperture to the circular aperture. The perimeter of the square aperture and the face lower edges bound a planar lower surface peripheral region, and the perimeter of the circular aperture and the face upper edges bound an upper surface peripheral region. Each pair of mutually orthogonal upper edges determine a radiused corner. A portion of the upper surface peripheral region proximate to each corner has an elliptically-shaped trough beveled outwardly at a downward angle. Portions of the upper surface peripheral region exterior to the troughs are planar. The faces are circumscribed by a horizontal concrete line at a predetermined distance below the base portion upper surface. The stanchion further includes a circular flange with opposed planar upper and lower surfaces orthogonal to the base portion faces. The flange has a square aperture coinciding with the aperture in the base portion lower surface. The flange upper surface is rigidly attached to the lower surface peripheral region of the base portion. The stanchion further includes a first pair of opposed vertical side walls each having a lower end rigidly attached and orthogonal to a planar portion of the upper surface peripheral region. Each side wall has an upper portion terminating in an upper end, with each upper portion having a planar exterior surface. The thickness of each side wall tapers decreasingly from the lower end to the upper end. The stanchion further includes a second pair of opposed vertical side walls, each orthogonal to the first pair. Each side wall has a lower end rigidly attached and orthogonal to a planar portion of the upper surface peripheral region, and an upper portion terminating in an upper end. The thickness of each side wall tapers decreasingly from the lower end to the upper end. The lower ends of each pair of adjacent side walls are separated by a gap, the gap and upper surface peripheral region proximate to the gap determining a trough.

The column base further includes a diaphragm having a circular central portion circumscribed by a relatively thin annular lip. The central portion has a convex upper surface and a planar lower surface, and the lip has planar upper and lower surfaces. The central portion diameter is such that the central portion is closely received within the circular aperture in the base portion upper surface. The lip outer diameter is such that the lip is closely received between the circumferential perimeter determining the circular aperture and the side walls.

The column base further includes a cap having a first pair of opposed lateral faces and a second pair of opposed lateral faces orthogonal to the first pair. Each contiguous pair of orthogonal faces is rigidly attached along a common edge. Each face has parallel top and bottom edges, with each contiguous pair of bottom edges determining a bottom corner edge. The cap further includes a top face having four independently flexible web portions. Each web portion is rigidly attached along the top edge of a lateral face. The web portions determine a square aperture through which the wood column is closely and slidably received. The stanchion side walls are closely received within the cap lateral faces when the cap is slid downwardly until the cap lateral face bottom edges are at a common predetermined distance from the concrete line.

The column base further includes: means for stiffening the side walls against transverse loads; means for stiffening the base portion against up-loads and down-loads; means for minimizing moisture seepage into the base portion; means for draining water accumulated above the diaphragm; and means for protecting the lowermost portion of the wood column from moisture, heat, fungus, and wood parasites. The means for stiffening the side walls includes a pair of opposed downwardly tapering gussets. Each gusset has an upper edge coinciding with the upper end of the upper portion of one of the first pair of side walls, and is rigidity attached to the exterior surface of the upper portion. The combined thickness along the length of each gusset and attached side wall upper portion is about constant and about equal to the thickness of the side wall lower end. The means for stiffening the side walls further includes at least one shim interposed between a side wall upper portion and the wood column. The means for stiffening the base portion includes the flange aperture and base portion cavity being filled with poured concrete up to the circular aperture less the thickness of the diaphragm central portion. The means for minimizing moisture seepage includes the diaphragm central portion being inserted within the circular aperture and resting on the concrete so that the weight carried by the wood column compresses the diaphragm lip against the upper surface peripheral region. The means for draining water includes four apertures each determined by a separation between a beveled trough and a cap face bottom corner edge. The means for protecting the lowermost portion of the wood column includes immersion of the base portion in concrete to a depth such that the concrete surface exterior to the base portion is at the concrete line, with each cap face bottom corner edge and proximate trough separated to form an aperture. The means for protecting the lowermost portion of the wood column further includes the web portions in pressing contact with the wood column.

In a fourth aspect the invention provides a column base for housing and supporting the lowermost portion of a wood column with a square cross-section. The column base includes a stanchion having a solid base portion with a first pair of opposed vertical faces and a second pair of opposed vertical faces each orthogonal to the first pair. Each pair of mutually orthogonal faces is contiguous along a vertical edge, and each face has horizontal lower and upper edges. The base portion has a lower surface bounded by the face lower edges, and an upper surface bounded by the face upper edges. The lower surface has a square aperture with radiused vertices, and the upper surface has a circular aperture. The base portion has a symmetrically disposed cavity tapering inwardly from the square aperture to the circular aperture. The perimeter of the square aperture and the face lower edges bound a planar lower surface peripheral region, and the perimeter of the circular aperture and the face upper edges bound an upper surface peripheral region. Each pair of mutually orthogonal upper edges determine a radiused corner. A portion of the upper surface peripheral region proximate to each corner has an elliptically-shaped trough beveled outwardly at a predetermined downward angle. Portions of the upper surface peripheral region exterior to the troughs are planar. The faces are circumscribed by a horizontal concrete line at a predetermined distance below the base portion upper surface. The stanchion further includes a circular flange with opposed planar upper and lower surfaces orthogonal to the base portion faces. The flange has a circumferential outer portion with a plurality of holes bounded by a circumferential edge, and two pairs of opposed "U"-shaped knock-out shims. Each shim has opposed parallel legs rigidly attached to a base and separated by a gap, the base and gap determining a slot open at the circumferential edge. The flange further has a generally square aperture coinciding with the aperture in the base portion lower surface. The flange upper surface is rigidly attached to the lower surface peripheral region of the base portion. The stanchion further includes a first pair of opposed vertical side walls, each having a lower end rigidly attached and orthogonal to a planar portion of the upper surface peripheral region, with the lower ends radiused into the planar portions. Each side wall has an upper portion terminating in an upper end, with each upper portion having a planar exterior surface. The thickness of each side wall tapers decreasingly from the lower end to the upper end. The stanchion further includes a second pair of opposed vertical side walls, each orthogonal to the first pair. Each side wall has a lower end rigidly attached and orthogonal to a planar portion of the upper surface peripheral region, with the lower ends radiused into the planar portions, and an upper portion terminating in an upper end. The thickness of each side wall tapers decreasingly from the lower end to the upper end. The lower ends of each pair of adjacent side walls are separated by a gap, the gap and upper surface peripheral region proximate to the gap determining a trough. The stanchion further includes a pair of opposed downwardly tapering gussets. Each gusset has an upper edge coinciding with the upper end of the upper portion of one of the first pair of side walls, and is rigidly attached to the exterior surface of the upper portion. The combined thickness along the length of each gusset and attached side wall upper portion is about constant and about equal to the thickness of the side wall lower end.

The column base further includes a diaphragm having a circular central portion circumscribed by a relatively thin annular lip. The central portion has a convex upper surface and a planar lower surface, and the lip has planar upper and lower surfaces. The central portion diameter is such that the central portion is closely received within the circular aperture in the base portion upper surface. The lip outer diameter is such that the lip is closely received between the circumferential perimeter determining the circular aperture and the side walls.

The column base further includes a cap having a first pair of opposed rectangular lateral faces and a second pair of opposed rectangular lateral faces orthogonal to the first pair. The faces have a common thickness. Each contiguous pair of orthogonal faces is rigidly attached along a common vertical edge. Each face has parallel top and bottom edges, with each contiguous pair of bottom edges determining a bottom corner edge. Each of the first pair of faces has a vertical groove in its interior surface extending between the top and bottom edges, and a slot of a common length, determined by a slot end distal to the bottom edge of the face, symmetrically disposed within the groove. Each of the second pair of faces has a slot of a common, shorter length determined by a slot end distal to the bottom edge of the face. The cap further includes a square top face having four independently flexible web portions. The web portions determine a square aperture through which the wood column is closely and slidably received. Each web portion tapers from a relatively thick end rigidly attached along the top edge of a lateral face to a relatively thin end in pressing contact with the wood column. The stanchion side walls are closely received within the cap lateral faces and the gussets are closely received within the grooves when the cap is slid downwardly to a stop position. The stop position is reached when the ends of the longer slots contact a transverse bolt through the upper portion of the first side wall, the wood column, and the upper portion of the second side wall, and the ends of the shorter slots contact a transverse bolt through the third side wall, the wood column, and the fourth side wall. The stop position determines a predetermined distance between each cap lateral face bottom edge and the concrete line.

In a fifth aspect the invention provides a column base for housing and supporting the lowermost portion of a wood column with a square cross-section. The column base includes a stanchion having a solid base portion with a first pair of opposed vertical faces and a second pair of opposed vertical faces each orthogonal to the first pair. Each pair of mutually orthogonal faces is contiguous along a vertical edge, and each face has horizontal lower and upper edges. The base portion has a lower surface bounded by the face lower edges, and an upper surface bounded by the face upper edges. The lower surface has a square aperture with radiused vertices, and the upper surface has a circular aperture. The base portion has therethrough a symmetrically disposed cavity tapering inwardly from the square aperture to the circular aperture. The perimeter of the square aperture and the face lower edges bound a planar lower surface peripheral region, and the perimeter of the circular perimeter and the face upper edges bound an upper surface peripheral region. Each pair of mutually orthogonal upper edges determine a radiused corner. A portion of the upper surface peripheral region proximate to each corner has an elliptically-shaped trough beveled outwardly at a predetermined downward angle. Portions of the upper surface peripheral region exterior to the troughs are planar. The faces are circumscribed by a horizontal concrete line at a predetermined distance below the base portion upper surface. The stanchion further includes a circular flange with opposed planar upper and lower surfaces orthogonal to the base portion faces, and a circumferential outer portion with a plurality of holes bounded by a circumferential edge. The flange further has a square aperture coinciding with the aperture in the base portion lower surface. The flange upper surface is rigidly attached to the lower surface peripheral region of the base portion. The stanchion further includes a first pair of opposed vertical side walls, each having a lower end rigidly attached and orthogonal to a planar portion of the upper surface peripheral region, with the lower ends radiused into the planar portions. Each side wall has an upper portion terminating in an upper end. The thickness of each side wall tapers decreasingly from the lower end to the upper end. The stanchion further includes a second pair of opposed vertical side walls, each orthogonal to the first pair. Each side wall has a lower end rigidly attached and orthogonal to a planar portion of the upper surface peripheral region, with the lower ends radiused into the planar portions, and an upper portion terminating in an upper end. The thickness of each side wall tapers decreasingly from the lower end to the upper end. The lower ends of each pair of adjacent side walls are separated by a gap, with the gap and upper surface peripheral region proximate to the gap determining a trough.

The column base further includes a diaphragm having a circular central portion circumscribed by a relatively thin annular lip. The central portion has a convex upper surface and a planar lower surface, and the lip has planar upper and lower surfaces. The central portion diameter is such that the central portion is closely received within the circular aperture in the base portion upper surface. The lip outer diameter is such that the lip is closely received between the circumferential perimeter determining the circular aperture and the side walls.

The column base further includes a cap having a first pair of opposed rectangular lateral faces and a second pair of opposed rectangular lateral faces orthogonal to the first pair. The faces have a common thickness. Each contiguous pair of mutually orthogonal faces is rigidly attached along a common vertical edge. Each face has parallel top and bottom edges, with each contiguous pair of bottom edges determining a bottom corner edge. Each of the first pair of faces has a slot of a common length, determined by a slot end distal to the bottom edge of the face. Each of the second pair of faces has a slot of a common, shorter length determined by a slot end distal to the bottom edge of the face. The cap further includes a square top face having four independently flexible web portions. The web portions determine a square aperture through which the wood column is closely and slidably received. Each web portion tapers from a relatively thick end rigidly attached along the top edge of a lateral face to a relatively thin end in pressing contact with the wood column. The stanchion side walls are closely received within the cap lateral faces when the cap is slid downwardly to a stop position. The stop position is reached when the ends of the longer slots contact a transverse bolt through the upper portion of the first side wall, the wood column, and the upper portion of the second side wall, and the ends of the shorter slots contact a transverse bolt through the third side wall, the wood column, and the fourth side wall. The stop position determines a predetermined distance between each cap lateral face bottom edge and the concrete line.

The column base can be installed either by being seated on top of a concrete pad and bolted down, or immersed in concrete and secured beneath the concrete surface with or without J-bolts. Immersion is preferred in regions where strong winds are a construction consideration. Use of J-bolts is preferred in regions at risk to hurricanes.

A more complete understanding of the present invention and other objects, aspects and advantages thereof will be gained from a consideration of the following description of the preferred embodiments read in conjunction with the accompanying drawings provided herein.

DESCRIPTION OF THE PREFERRED EMBODIMENTS

Figure 1:
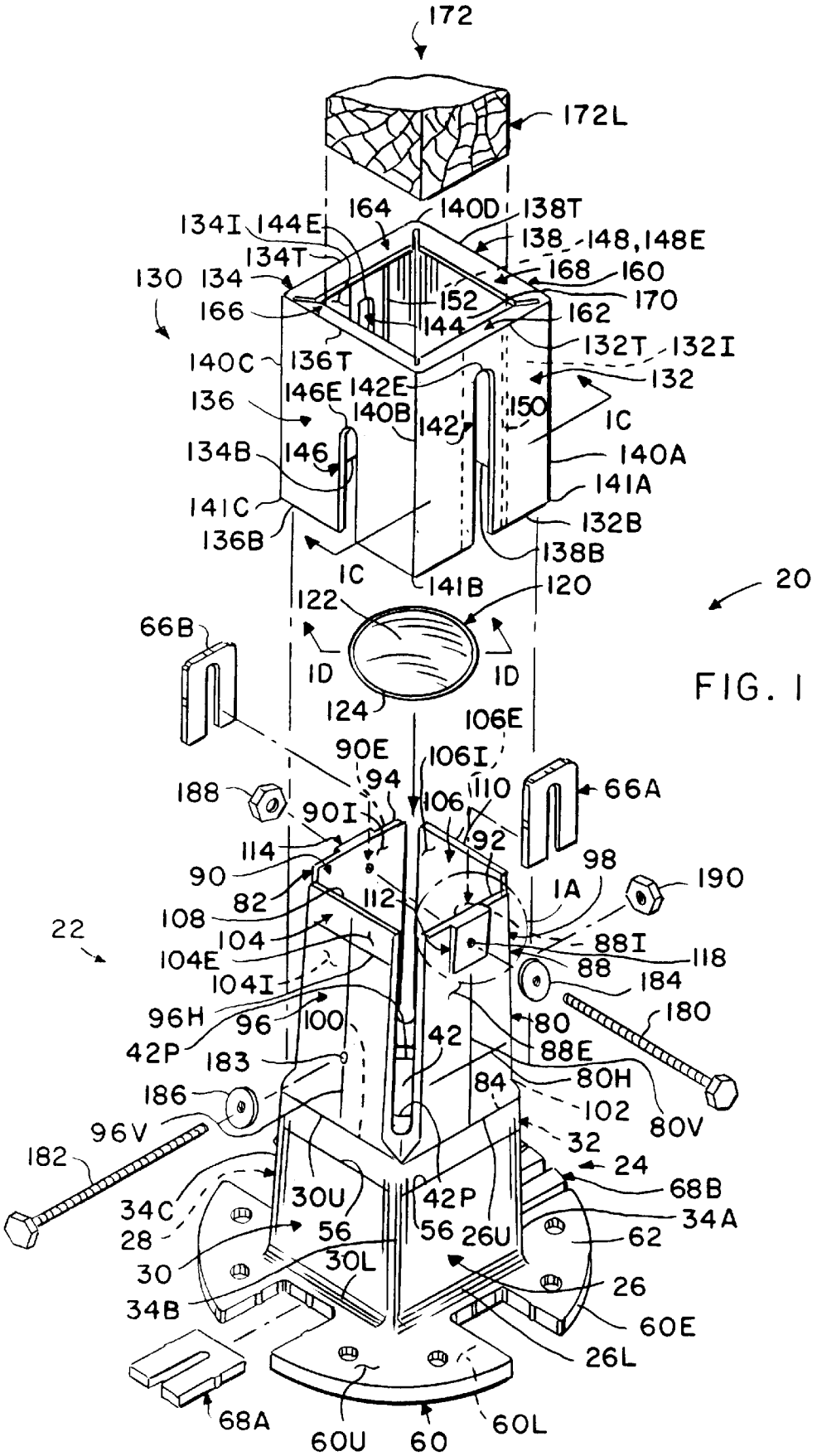
FIG. 1 is an exploded perspective view of a column base including a stanchion, a diaphragm, and a slidable cap. The stanchion has opposed first and second vertical side walls, opposed third and fourth vertical side walls, a solid base portion having a cavity bounded by a circular upper aperture and a square lower aperture and circumscribed by a concrete fill line, and a base flange with four knock-out shims. A nominally square cross-section wood column, whose base rests on the diaphragm which sits on concrete filling the cavity, is secured by an upper bolt through a first gusset molded to the first side wall, a first shim, the column, a second shim, the second side wall, and a second gusset molded to the second side wall, and by a lower bolt through the third side wall, column, and fourth side wall. The cap has a square aperture bounded by four flexible web portions, opposed upper bolt slots each bounded by a gusset groove, and opposed lower bolt slots.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims. Nor is there an intention to limit application of the invention to housing construction. Specifically, the invention is readily adaptable to provide a base for supporting columns used in other structures such as decks, porches, garages, car ports, and farm sheds and other such outbuildings.

Where used herein, the words "rigidly attached" mean that the parts referred to are monolithically molded in a single piece from a thermoplastic. However, other forms of attachment may be suitable, consistent with simplicity of manufacture and reliability of operation. Where used herein, the words "connect" and "connected" mean that the parts referred to (e.g., a J-bolt connected to the stanchion flange) can be readily separated after being joined together in an interlocking combination. Where used herein, the phrases "identical in configuration" and "in the same configuration" mean that an element of the second embodiment although structurally, physically and functionally identical to a corresponding element of the first embodiment, is sized smaller.

Figure 2:
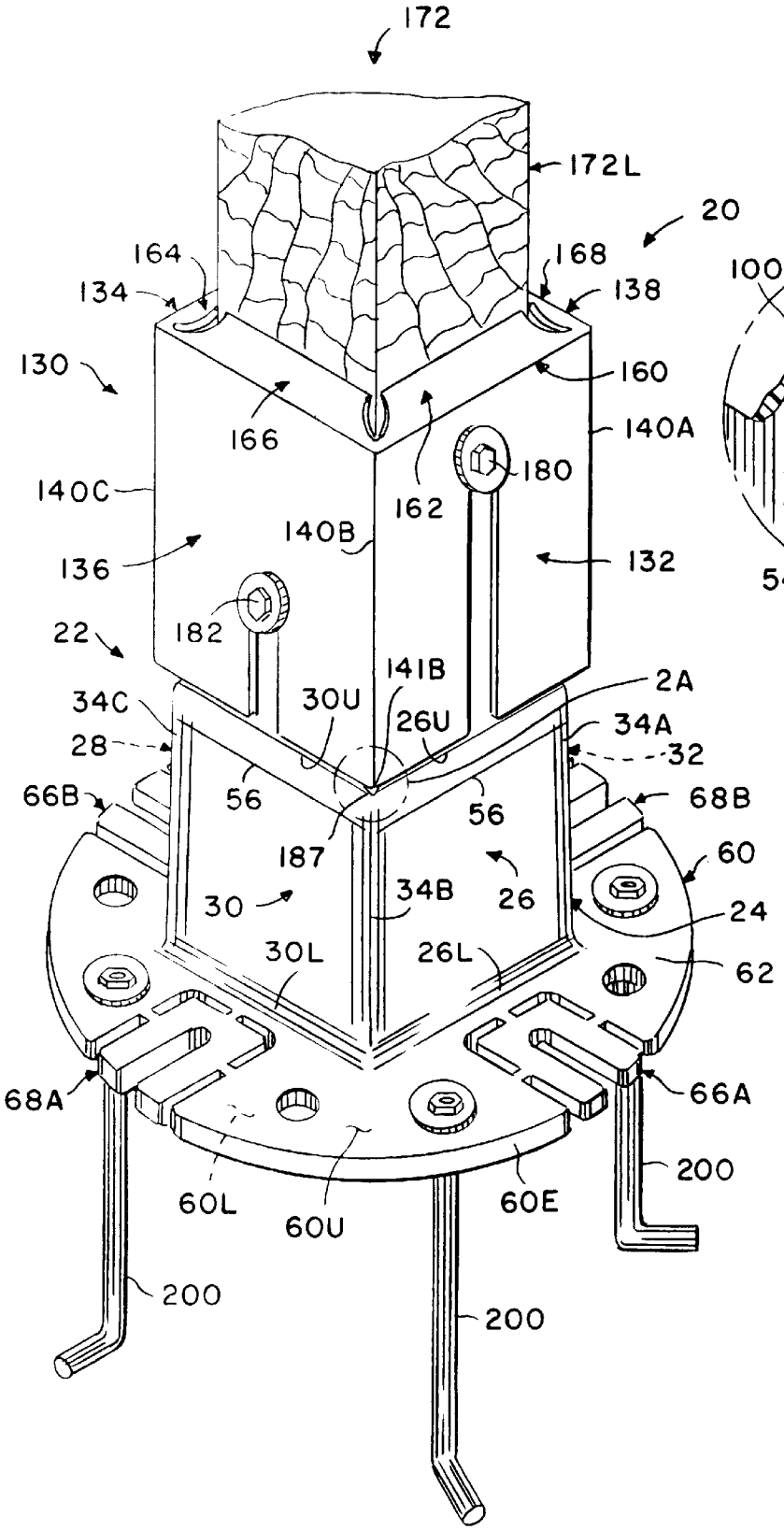
FIG. 2 is a perspective view of the FIG. 1 column base and wood column, with J-bolts (optionally) connected to alternate bolt holes in the base flange.
Figure 4:
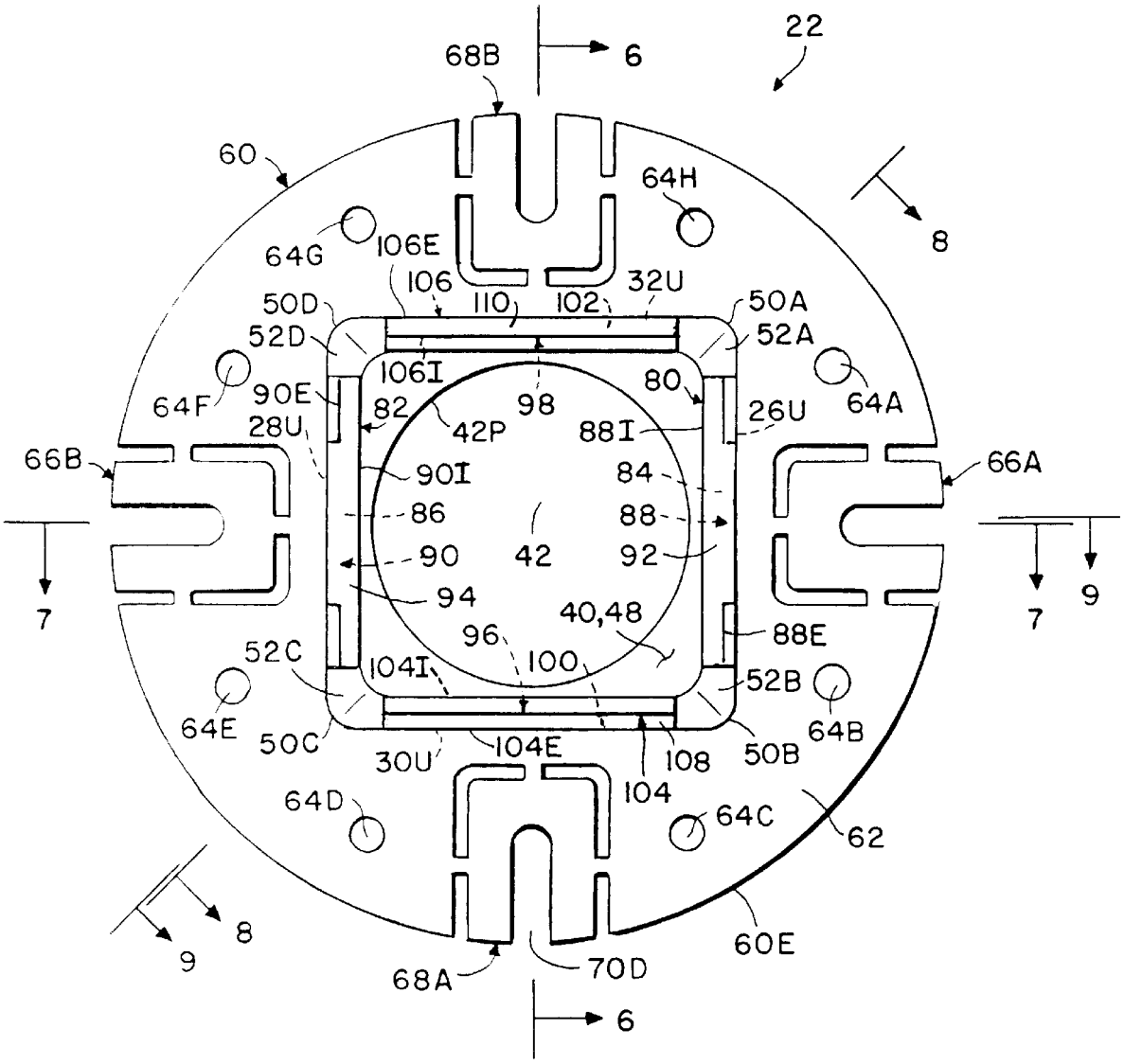
FIG. 4 is a top plan view of the FIG. 1 stanchion showing the upper surface peripheral region which bounds the circular aperture of the base portion cavity, and FIG. 2A side wall lower ends radiused into the upper surface peripheral region.
Figure 5:
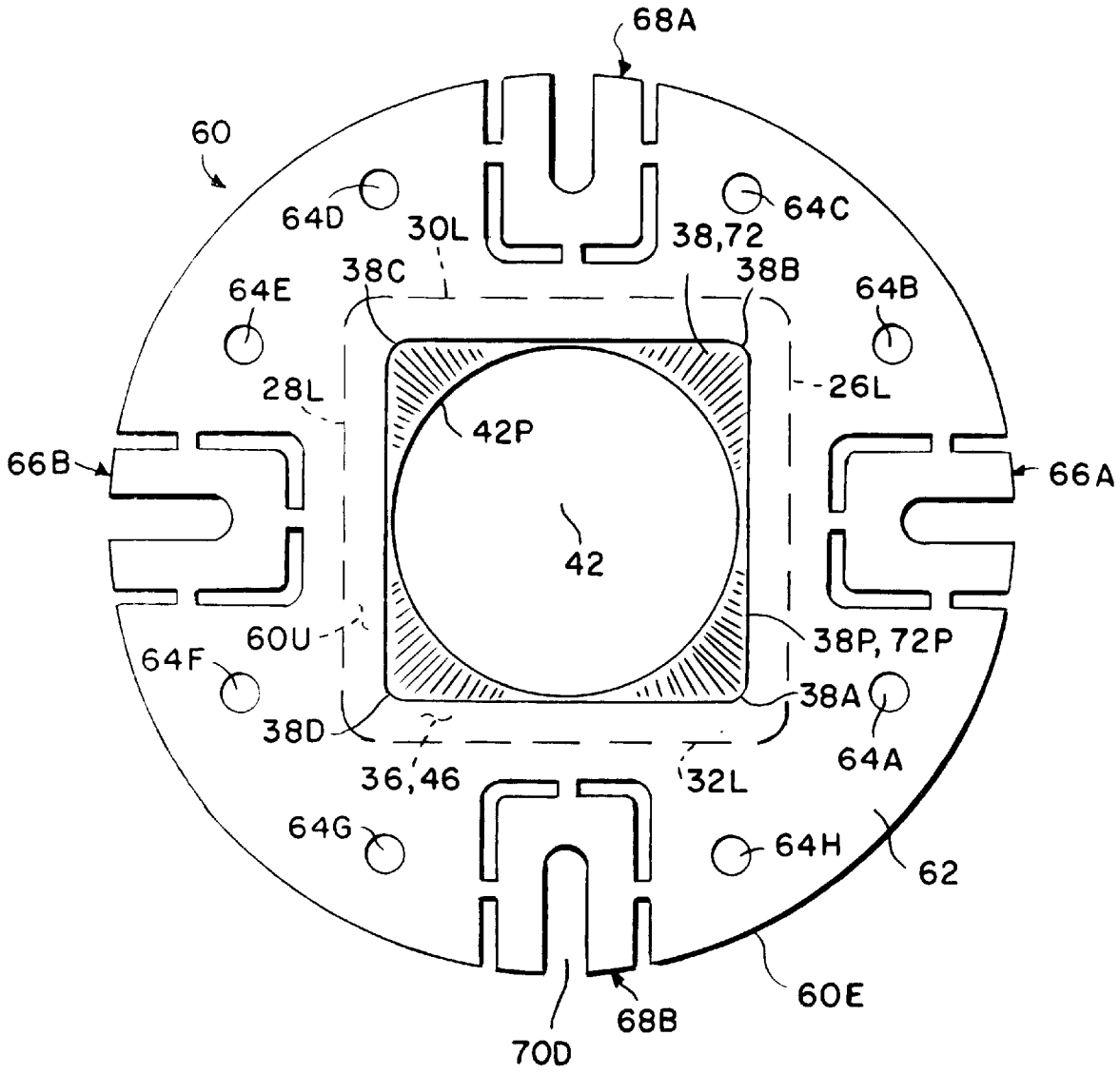
FIG. 5 is a bottom plan view of the FIG. 1 stanchion showing the circular upper aperture, the square lower aperture determined by the base portion lower ends radiused into the base flange, and the lower surface peripheral region of the base portion.
Figure 8:
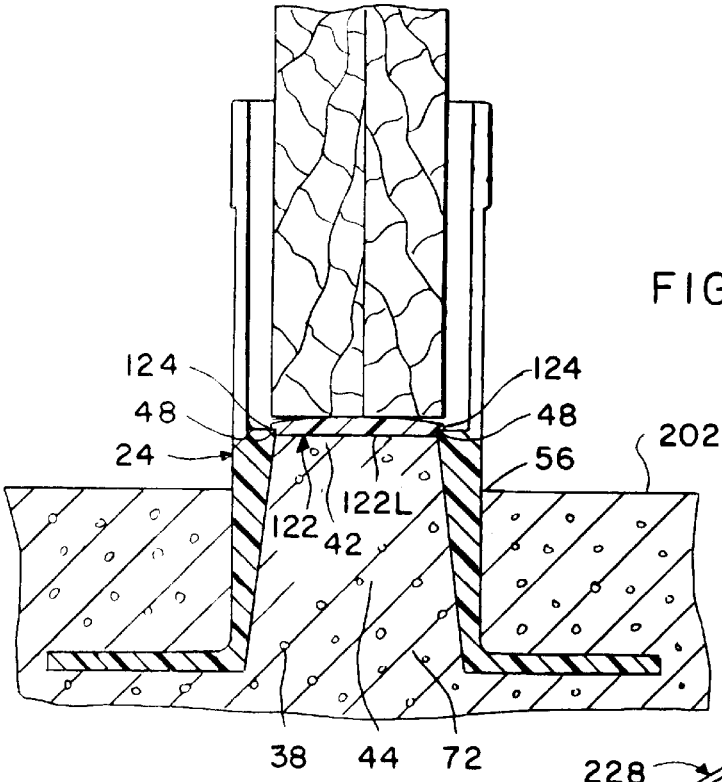
FIG. 8 is a side elevational, partial sectional view of the FIGS. 1, 2 stanchion and wood column, along lines 8—8 of FIG. 4.

Referring to FIGS. 1 and 2, a column base 20 according to a first embodiment of the invention includes a stanchion 22 having a solid base portion 24 determined by opposed generally vertical, generally planar first and second faces 26, 28, and opposed generally vertical, generally planar third and fourth faces 30, 32 each generally orthogonal to faces 26, 28. Each pair of mutually orthogonal faces (32, 26), (26, 30), (30, 28), (28, 32) are contiguous along a radiused vertical edge, of which three, 34A, 34B, 34C, are visible. Each face has generally horizontal lower and upper edges, of which two pairs (26L, 26U) and (30L, 30U) are visible. As best appreciated from FIG. 5, the face lower edges 26L, 28L, 30L, 32L bound a generally planar base portion lower surface 36 having a symmetrically disposed aperture 38 determined by a generally square perimeter 38P with four radiused vertices 38A, 38B, 38C, 38D. As best appreciated from FIGS. 4 and 5, the face upper edges bound a generally planar base portion upper surface 40 having a symmetrically disposed aperture 42 determined by a generally circular perimeter 42P. As best seen in FIG. 8, the base portion 24 has therethrough a symmetrically disposed cavity 44 tapering inwardly from the square aperture 38 to the circular aperture 42. Referring to FIG. 5, the perimeter 38P and face lower edges 26L, 28L, 30L, 32L bound a lower surface peripheral region 46. Referring to FIG. 4, the perimeter 42P and face upper edges 26U, 28U, 30U, 32U bound an upper surface peripheral region 48. Each pair of mutually orthogonal upper edges (32U, 26U), (26U, 30U), (30U, 28U), (28U, 32U) meet in a radiused corner 50A, 50B, 50C, 50D, respectively. The portion of the upper peripheral region proximate to each corner has an elliptically-shaped trough 52A, 52B, 52C, 52D, respectively, beveled outwardly at a downward angle. Preferably, the angle is about 30 degrees. Each trough has a chisel-shaped central portion 54 (see FIG. 2A). Portions of region 48 exterior to the troughs are generally planar. Referring again to FIGS. 1 and 2, the base portion faces are circumscribed by a generally horizontal "concrete line" 56 at a predetermined distance below the upper surface 40 (see FIG. 4), which indicates the depth to which stanchion 22 should be sunk into wet concrete. Preferably, line 56 is embossed on the faces.

Figure 1A:
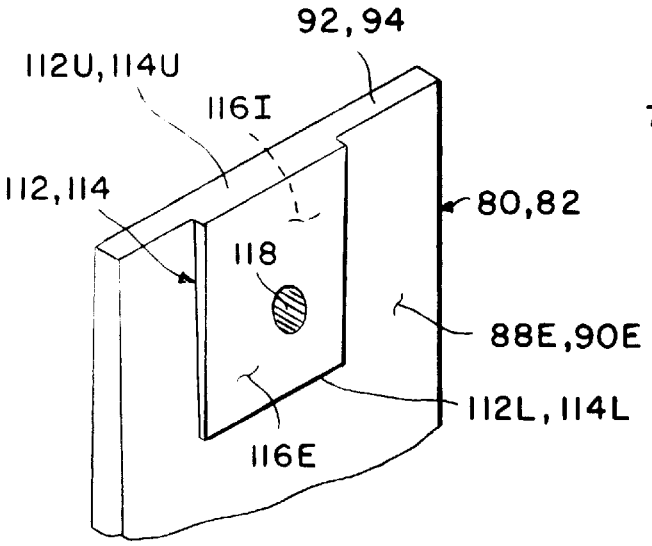
FIG. 1A is a detail view of the circled region "1A" in FIG. 1, including the first gusset and first vertical side wall, with an upper bolt hole through the gusset and side wall.
Figure 1B:
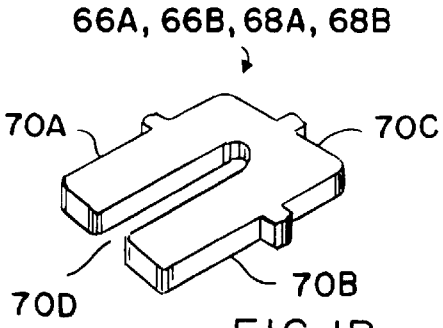
FIG. 1B is a perspective view of a FIG. 1 shim.

Still referring to FIGS. 1 and 2, the stanchion 22 further includes a circular flange 60 having opposed generally planar lower and upper surfaces 60L, 60U, respectively, generally orthogonal to the base portion faces. Flange 60 includes a circumferential outer portion 62 bounded by a circumferential edge 60E. As best shown in FIGS. 4 and 5, outer portion 62 has therethrough eight symmetrically disposed bolt-holes 64A, 64B, 64C, 64D, 64E, 64F, 64G, 64H. Referring again to FIGS. 1 and 2, outer portion 62 includes opposed first and second "U"-shaped knock-out shims 66A, 66B of a first common thickness, and opposed third and fourth U-shaped knock-out shims 68A, 68B of a second common thickness. As shown in FIG. 1B, each shim has opposed first and second parallel legs 70A, 70B rigidly attached to a base 70C and separated by a gap determining a slot 70D. Slot 70D has a width which closely accommodates a bolt of a prescribed size. As shown in FIGS. 4 and 5, shims 66A, 66B, 68A, 68B are symmetrically disposed between adjacent pairs of the bolt-holes 64A–64H, with each slot 70D open at edge 60E. Preferably, the thickness of shims 66A, 66B is ⅛-inch, and the thickness of shims 68A, 68B is ¼-inch. As shown in FIG. 5, flange 60 has a generally square aperture 72 therethrough determined by a perimeter 72P congruent to perimeter 38P. The portion of the flange upper surface 60U congruent to the base portion lower surface 36 is rigidly attached thereto.

Figure 2A:
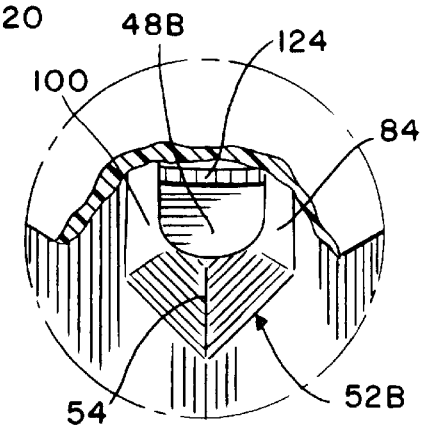
FIG. 2A is a detail perspective view of the circled region "2A" in FIG. 2 showing an aperture determined by an elliptically-shaped trough in the stanchion base portion upper surface, a pair of contiguous radiused side wall bottoms, and a cap bottom corner edge.

Referring to FIGS. 1 and 4, stanchion 22 further includes opposed first and second generally vertical side walls 80, 82 each having, respectively, a lower end 84, 86 of a common thickness rigidly attached, generally orthogonal and radiused to upper surface peripheral region 48, and an upper portion 88, 90, respectively, having a generally planar exterior surface 88E, 90E, respectively, and a generally planar interior surface 88I, 90I, respectively. Each side wall upper portion 88, 90 terminates, respectively, in an upper end 92, 94 having a common thickness less than the thickness of lower ends 84, 86. Each side wall 80, 82 tapers decreasingly in thickness and decreasingly in width from the lower end to the upper end. Stanchion 22 further includes opposed third and fourth generally vertical side walls 96, 98 each having, respectively, a lower end 100, 102 of the thickness of lower ends 84, 86 rigidly attached, generally orthogonal and radiused to peripheral region 48, and an upper portion 104, 106, respectively, having a generally planar exterior surface 104E, 106E, respectively, and a generally planar interior surface 104I, 106I, respectively. Each side wall upper portion 104, 106 terminates, respectively, in an upper end 108, 110 having the thickness of upper ends 92, 94. Each side wall 96, 98 tapers decreasingly in thickness and decreasingly in width from the lower end to the upper end. Side walls 96, 98 are each generally orthogonal to side walls 80, 82. As shown in FIG. 4, each pair (102, 84), (84, 100), (100, 86), (86, 102) of lower ends of adjacent side walls are separated by a gap which together with the portion of upper surface peripheral region 48 proximate to the gap determine troughs 52A, 52B, 52C, 52D, respectively. FIG. 2A shows how side wall lower ends 84, 100 and proximate portion 48B of region 48 bound trough 52B.

Referring to FIG. 1, stanchion 22 includes opposed first and second gussets 112, 114 of a common length and a common width rigidly attached, respectively, to exterior surfaces 88E, 90E of the upper portions of side walls 80, 82. Referring to FIG. 1A, the gussets each have a generally planar interior surface 116I which is attached to the corresponding upper portion exterior surface, upper edges 112U, 114U, respectively, which coincide, respectively, with upper ends 92, 94, a generally planar exterior surface 116E generally orthogonal to flange 60, and lower edges 112L, 114U. Edges 112U, 114U have a common thickness which is greater than the common thickness of edges 112L, 114L, so that the gussets taper downwardly. The taper is such that along the gusset length the combined thickness of the gusset and upwardly tapering side wall upper portion is about constant and about equal to the common thickness of lower ends 84, 86. Preferably, the gusset width is about 80 percent of its length. Gussets 112, 114 each have therethrough a hole 118 whose center is at a predetermined distance below upper edge 112U, 114U, respectively. Preferably, this distance is about 1½ inches. The holes may be "starter" holes to assist a worker at the construction site in positioning a drill bit to drill a generally horizontal hole through the stanchion first and second sidewalls and the lowermost portion of the wood column therebetween, to accommodate a bolt of a selected size, or the holes may be predrilled to accommodate a standard bolt size.

Figure 1C:
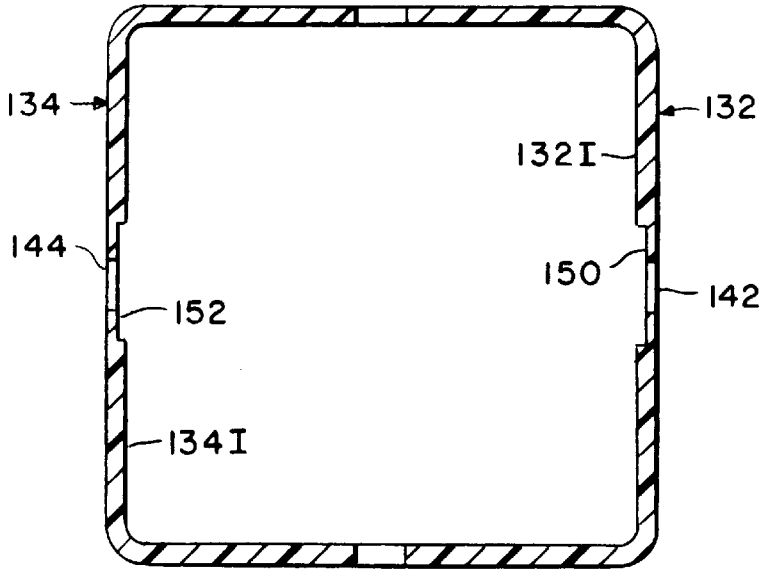
FIG. 1C is a cross-sectional view of the FIG. 1 cap taken along cutting plane 1C—1C.
Figure 1D:
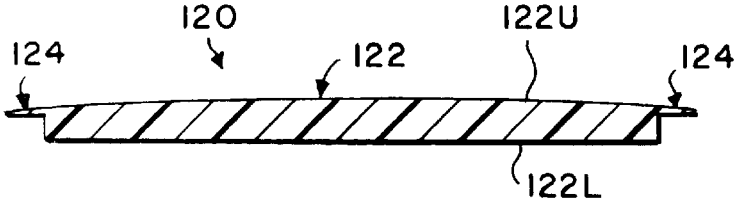
FIG. 1D is a cross-sectional view of the FIG. 1 diaphragm taken along cutting plane 1D—1D.
Figure 6:
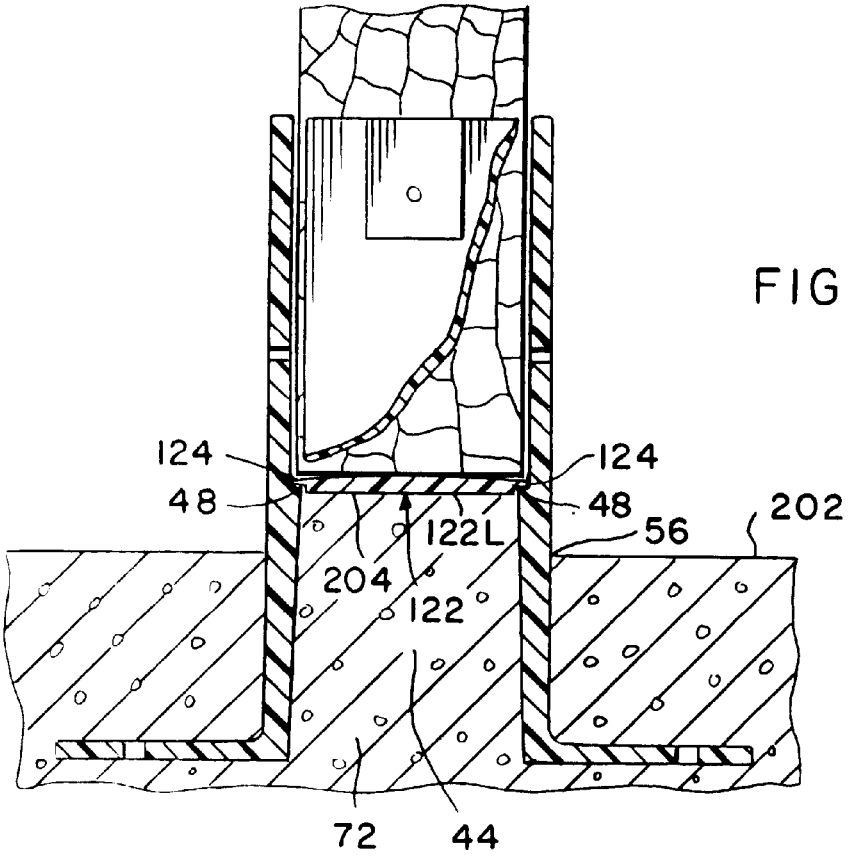
FIG. 6 is a side elevational, partial sectional view of the FIGS. 1, 2 stanchion and wood column along lines 6—6 of FIG. 4, showing the stanchion immersed in concrete up to the concrete line, concrete fill inside the base portion cavity, and the diaphragm, compressed by the weight carried by the column, sealing the cavity against moisture.
Figure 7:
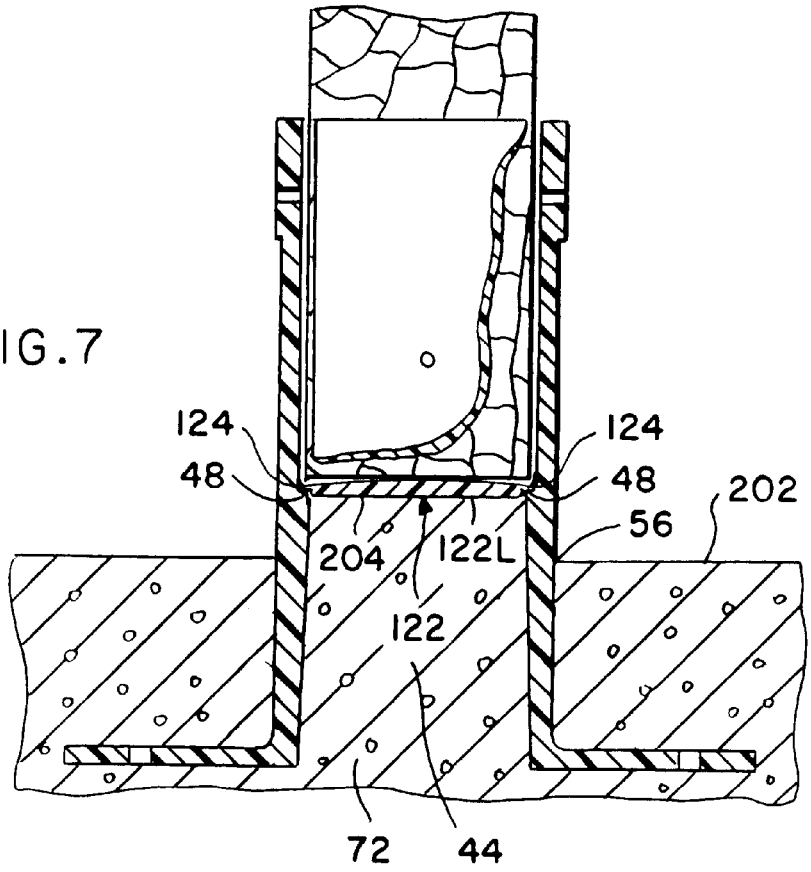
FIG. 7 is a side elevational, partial sectional view of the FIGS. 1, 2 stanchion and wood column, along lines 7—7 of FIG. 4.

Referring to FIGS. 1 and 1D, the column base 20 further includes a diaphragm 120 having a generally circular central portion 122 having a convexly arcuate upper surface 122U and a generally planar lower surface 122L. The diameter of central portion 122 is such that the central portion is closely received within circular aperture 42. The central portion is circumscribed by a relatively thin annular lip 124 sized to be closely received between perimeter 42P and side walls 80, 96, 82, 98. FIGS. 6 and 7 show lip 124 resting on upper surface peripheral region 48, and central portion 122 extending into cavity 44. FIG. 2A shows the proximity of lip 124 to side wall lower ends 84, 100.

Referring to FIGS. 1 and 2, the column base 20 further includes a cap 130 having opposed generally planar, generally rectangular first and second lateral faces 132, 134 and opposed generally rectangular third and fourth lateral faces 136, 138 generally orthogonal to faces 132, 134. Each face has a common thickness and each contiguous pair of mutually orthogonal faces (138, 132), (132, 136), (136, 134), (134, 138) is rigidly attached along a common generally vertical edge 140A, 140B, 140C, 140D, respectively. Faces 138, 132, 136, 134 have generally parallel top and bottom edges (138T, 138B), (132T, 132B), (136T, 136B), (134T, 134B), respectively. Each contiguous pair of bottom edges determine a bottom corner edge, of which three edges 141A, 141B, 141C are visible. Faces 132, 134 have, respectively, opposed slots 142, 144 of a common length determined, respectively, by arcuate-shaped slot ends 142E, 144E distal, respectively, to bottom edges 132B, 134B. Faces 136, 138 have, respectively, opposed slots 146, 148 of a common length determined, respectively, by arcuate-shaped slot ends 146E, 148E distal, respectively, to bottom edges 136B, 138B. The length of slots 146, 148 is shorter than the length of slots 142, 144. Referring to FIGS. 1 and 1C, each face 132, 134 has an interior surface 132I, 134I, respectively. Each interior surface 132I, 134I has a generally vertical groove 150, 152, respectively, extending between edges 132T, 132B and 134T, 134B, respectively, within which, respectively, slots 142, 144 are symmetrically disposed.

Figure 3A:
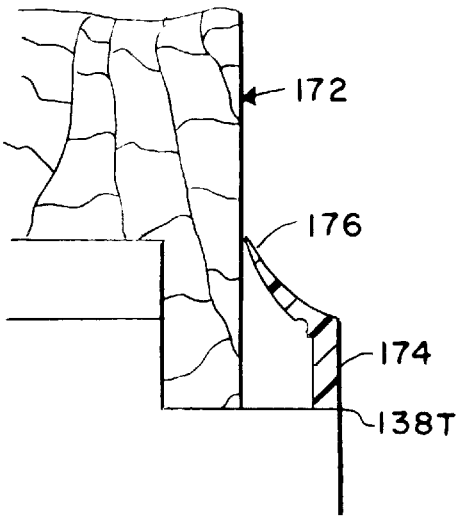
FIG. 3A is a cross-sectional view taken along cutting plane 3A—3A of FIG. 3, showing a FIG. 1 web portion.
Figure 3:
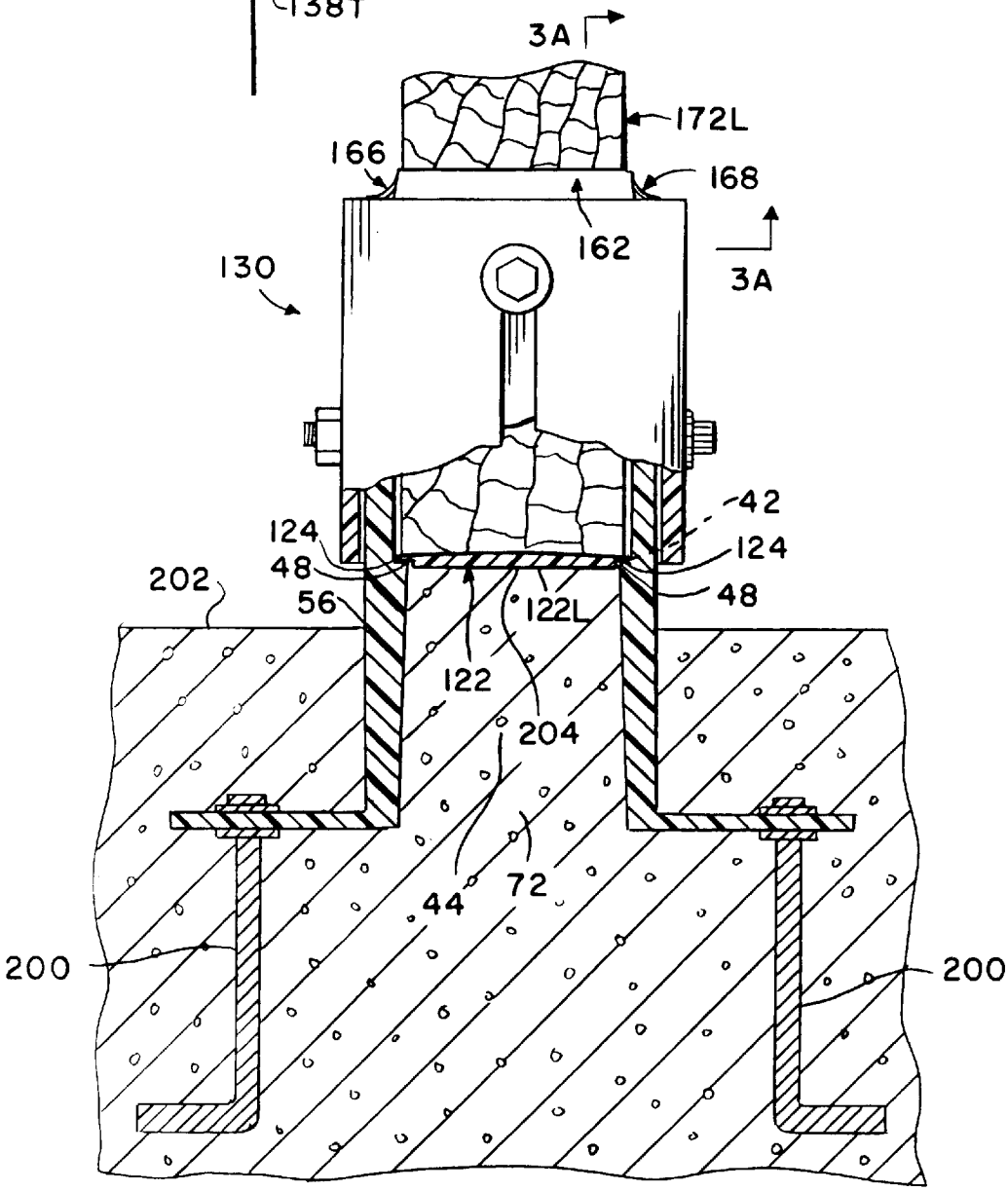
FIG. 3 is a side elevational, partial sectional view of the FIGS. 1, 2 column base with the wood column resting on the FIG. 1 diaphragm, the stanchion base portion cavity filled with concrete, the stanchion base portion immersed in concrete up to the FIG. 1 concrete fill line, and the FIG. 2 J-bolts connected to the base flange.

Referring to FIGS. 1, 2 and 3, cap 130 further includes a generally square top face 160 having four mutually orthogonal, independently flexible web portions 162, 164, 166, 168. The web portions determine a generally square aperture 170 through which the lowermost portion 172L of a wood column 172 having a generally square cross-section is closely and slidably received. Preferably, the column cross-section is nominally 6 inches×6 inches or 8 inches×8 inches. As depicted in FIG. 3A, each web portion tapers from a relatively thick end 174 rigidly attached along the top edge (here, 138T) of a lateral face to a relatively thin end 176 in pressing contact with the wood column.

Referring to FIGS. 1 and 2, side walls 80, 82 and 96, 98 are closely received within cap lateral faces 132, 134 and 136, 138, respectively, and gussets 112, 114 are closely received within grooves 150, 152, respectively, when cap 130 is slid downwardly to a stop position determined when slot ends 142E, 144E contact a transverse upper bolt 180 inserted through gusset 112, side wall upper portion 88, wood column portion 172L, side wall upper portion 90 and gusset 114, and slot ends 146E, 148E contact a transverse lower bolt 182 inserted through side wall 96, wood column portion 172L and side wall 98. Referring to FIG. 1, lower bolt 182 passes through a bolt-hole 183 in each side wall 96, 98 whose centers are at a predetermined distance below upper ends 108, 110. Typically, holes 183 are starter holes of ⅛-inch width. This convention allows margin for error at the building site during installation if the hole drilled through the wood column for upper bolt 180 does not coincide exactly with the starter or pre-drilled gusset hole on the opposite side. Such misalignment would weaken the stiffening and uplift capabilities of the distal gusset. Orthogonal sight lines, embossed on the two side walls adjacent to the two side walls being drilled, serve as guidelines during the drilling process. For example, horizontal sight line 80H on side wall 80 is disposed the same distance below upper end 92 as is the center of hole 183 in side wall 96 below upper end 108. A helper positioned to see both a sight line and the drill angle can advise the worker doing the drilling, enabling him to hit the opposite hole as precisely as possible as he bores through the wood column. Similarly, horizontal sight line 96H on side wall 96, which is disposed the same distance below upper end 108 as is the center of hole 118 below upper end 92, facilitates level drilling so that the upper bolt 180 can be inserted horizontally. Vertical sight lines, two of which, 80V, 96V, are shown in FIG. 1, facilitate immersing stanchion 22 in wet concrete generally vertically by adjusting the stanchion until a sight line is aligned with a plumb bob. Bolts 180, 182, which secure column portion 172L within stanchion 22, are secured to the side wall upper portions by washers 184, 186, respectively, and nuts 188, 190, respectively. To accommodate and correct deviation of the wood column cross-section from squareness, one or two of the shims 66A, 66B, 68A, 68B which have been removed from flange 60 at the building site are interposed between a side wall upper portion and column portion 172L. FIG. 1 shows shims 66A, 66B used for this purpose.

As shown in FIG. 2, at the stop position each corner edge is proximate to the corresponding trough (e.g., corner edge 141B and trough 52B), thereby forming a small "weep hole" aperture 187, and each cap lateral face bottom edge is at a predetermined distance above the concrete line 56. Thus, when cap 130 is seated upon stanchion 22, the small apertures minimize exposure of column base 20 to the environment while allowing water, e.g., flood water, which may collect above diaphragm 120 to drain out through troughs 52A, 52B, 52C, 52D (see FIG. 4).

Stanchion 22 may be either immersed in concrete or bolted to the surface of a concrete pad. As shown in FIGS. 2 and 3, a plurality of bolts 200 may be connected to the bolt-holes in flange 60. To anchor the stanchion in concrete, standard J-bolts of 6, 8 or 12 inches length are preferred.

Referring to FIGS. 3, 6, 7, 8 and 9, after stanchion 22 is immersed in concrete having a surface 202 generally coinciding with the concrete line 56 but before diaphragm central portion 122 is inserted within aperture 42, the flange aperture 72 and cavity 44 are filled with poured concrete up to aperture 42 less the thickness of central portion 122. Thus, the concrete level inside the stanchion, as determined by a concrete surface 204, is higher than the concrete level outside the stanchion. Also, when lip 124 is in contact with upper surface peripheral region 48, diaphragm lower surface 122L contacts surface 204. Although the load carried by wood column 172 is substantially borne by the concrete interior to the stanchion and the bolts, the diaphragm acts to spread the load force to the stanchion base portion and side walls. Lip 124 is compressed by the load against peripheral region 48 to effect a water-tight seal.

Figure 10:
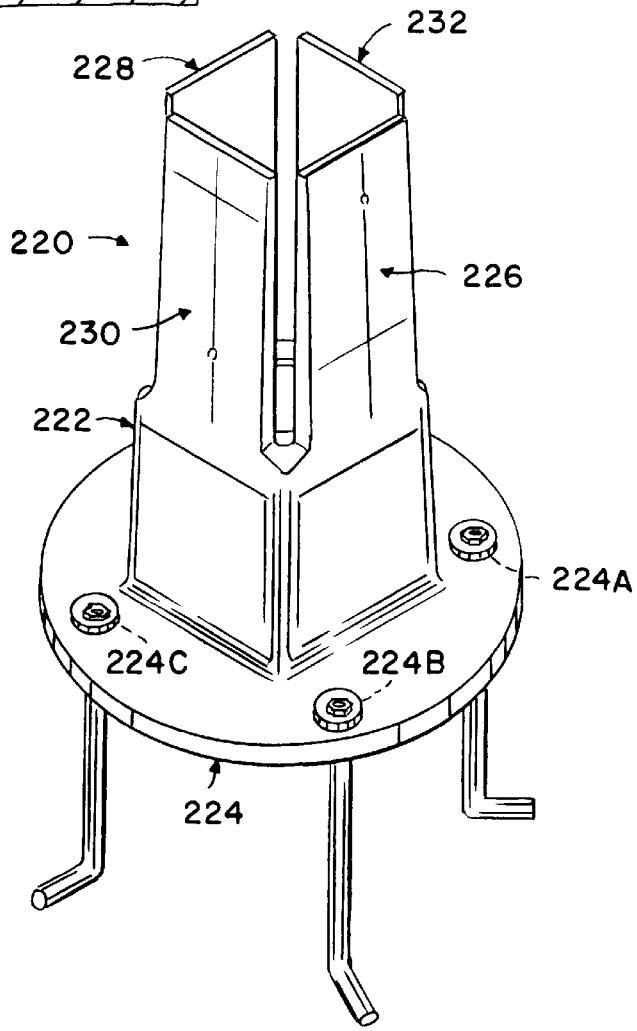
FIG. 10 is a perspective view of a second embodiment of a column base stanchion including opposed first and second vertical side walls, opposed third and fourth vertical side walls, a base portion having a cavity bounded by a circular upper aperture and a square lower aperture and circumscribed by a concrete fill line, and a base flange to which J-bolts are (optionally) connected.
Figure 9:
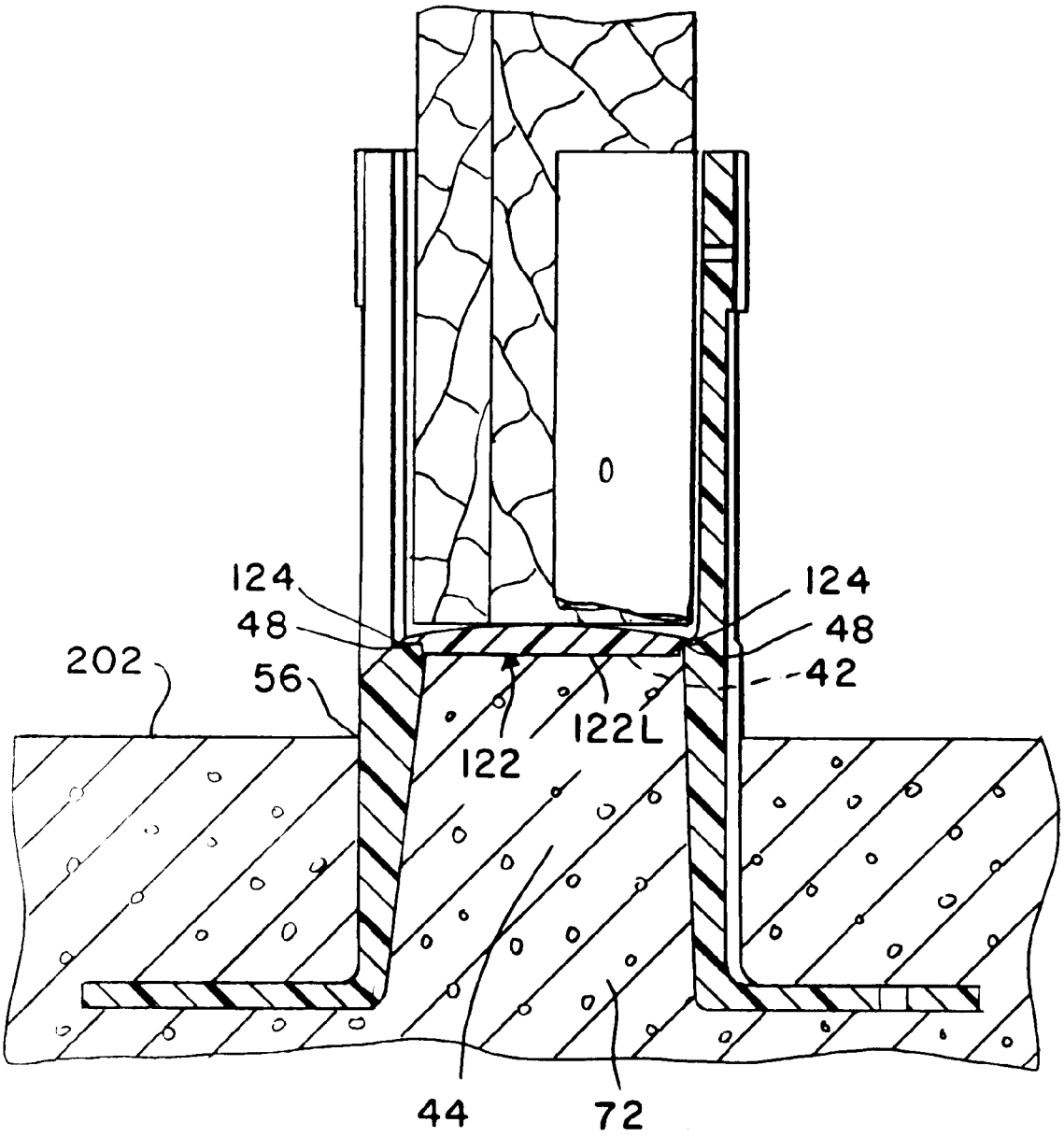
FIG. 9 is a side elevational, partial sectional view of the FIGS. 1, 2 stanchion and wood column, along lines 9—9 of FIG. 4.

Referring to FIG. 10, a stanchion 220 according to a second embodiment of the invention adapted to receive the lowermost portion of a nominally 4 inches×4 inches wood column includes a solid base portion 222 identical in configuration to base portion 24 of stanchion 22. Stanchion 220 further includes a circular flange 224 rigidly attached to base portion 222 in the same configuration as upper surface 60U of flange 60 is attached to lower surface 36 of base portion 24 (see FIG. 5). Flange 224 is identical in configuration to flange 60 except that there are four symmetrically disposed bolt-holes (of which three, 224A, 224B, 222C are visible) rather than eight bolt-holes, and flange 224 does not include knock-out shims. Stanchion 220 further includes opposed first and second generally vertical side walls 226, 228, and opposed third and fourth generally vertical side walls 230, 232 each generally orthogonal to side walls 226, 228. The side walls are rigidly attached to base portion 222 in the same configuration as lower ends 84, 86, 100, 102 are attached to upper surface peripheral region 48 of base portion 24 (see FIG. 4). Side walls 226, 228 are identical in configuration to side walls 80, 82 (see FIGS. 1, 4) except that gussets are not attached. Side walls 230, 232 are identical in configuration to side walls 96, 98 (see FIGS. 1, 4). A diaphragm adapted to fit within side walls 226, 228, 230, 232 is identical in configuration to diaphragm 120. A cap adapted to fit over stanchion 220 is identical in configuration to cap 130 except that, because there are no gussets, grooves are not provided in the interior surfaces of the lateral faces having the longer slots.

What is claimed is:

1. A column base for housing and supporting the lowermost portion of a wood column, the column base comprising a stanchion, the stanchion comprising:

a solid base portion having a generally horizontal lower surface and a generally horizontal upper surface, the lower surface having a first aperture determined by a first perimeter, the upper surface having a second aperture determined by a second perimeter, the base portion having a cavity therethrough extending between the first and second apertures;

a flange having an aperture therethrough determined by a perimeter generally congruent to said first perimeter, the flange rigidly attached to the base portion lower surface; and opposed first and second generally vertical side walls and opposed third and fourth generally vertical side walls, the third and fourth side walls each generally orthogonal to the first and second side walls, each side wall rigidly attached to the base portion upper surface.

2. The column base of claim 1, further comprising a diaphragm having a central portion of a predetermined thickness and a relatively thin lip circumscribing the central portion, the central portion having a convexly arcuate upper surface and a generally planar lower surface, the lip having generally planar upper and lower surfaces, the central portion closely received within said second aperture, the lip closely received between said second perimeter and said side walls.

3. The column base of claim 2, wherein said flange aperture and said base portion cavity are filled with poured concrete up to a level of said second aperture less said thickness of the diaphragm central portion.

4. The column base of claim 3, further comprising a cap, the cap comprising:

opposed first and second lateral faces and opposed third and fourth lateral faces orthogonal to the first and second faces, each contiguous pair of mutually orthogonal faces rigidly attached along a common edge, each face having generally parallel top and bottom edges, each contiguous pair of bottom edges determining a bottom corner edge; and a top face having four mutually orthogonal, independently flexible web portions, each web portion rigidly attached along the top edge of a lateral face, the web portions determining an aperture through which the wood column is closely and slidably received, the stanchion side walls closely received interior to the cap lateral faces when the cap is slid downwardly.

5. A column base for housing and supporting the lowermost portion of a wood column, the column base comprising a stanchion, the stanchion comprising:

a solid base portion determined by opposed, generally vertical first and second faces and opposed, generally vertical third and fourth faces, the third and fourth faces each generally orthogonal to the first and second faces, each pair of mutually orthogonal faces contiguous along a common, generally vertical edge, each face having generally horizontal lower and upper edges, the base portion further determined by a lower surface bounded by the face lower edges and by an upper surface bounded by the face upper edges, the lower surface having a first aperture determined by a first perimeter and the upper surface having a second aperture determined by a second perimeter, the base portion having a cavity therethrough extending between the first and second apertures, the first perimeter and face lower edges bounding a lower surface peripheral region, the second perimeter and face upper edges bounding an upper surface peripheral region, each pair of mutually orthogonal upper edges determining a corner, a portion of the upper surface peripheral region proximate to each corner having a trough beveled outwardly, portions of the upper surface peripheral region disposed exterior to the troughs being generally planar, the faces circumscribed by a generally horizontal concrete line at a predetermined distance below the base portion upper surface;

a flange having opposed upper and lower surfaces generally orthogonal to the base portion faces, the flange having an aperture therethrough determined by a perimeter generally congruent to said first perimeter, the flange upper surface rigidly attached to the lower surface peripheral region of the base portion, the flange lower surface a predetermined distance below said concrete line;

opposed first and second generally vertical side walls, each side wall having a lower end of a first predetermined thickness rigidly attached and generally orthogonal to a planar portion of the upper surface peripheral region, each side wall having an upper portion terminating in an upper end of a second predetermined thickness, each upper portion having a generally planar exterior surface, each side wall of a thickness tapering decreasingly from the lower end thickness to the upper end thickness; and opposed third and fourth generally vertical side walls, each side wall having a lower end of the first predetermined thickness rigidly attached and generally orthogonal to a planar portion of the upper surface peripheral region, each side wall having an upper portion terminating in an upper end of the second predetermined thickness, each side wall of a thickness tapering decreasingly from the lower end thickness to the upper end thickness, the third and fourth side walls each generally orthogonal to the first and second side walls, the lower ends of each pair of adjacent side walls separated by a gap, each gap and upper surface peripheral region proximate to the gap determining one of said troughs.

6. The column base of claim 5, further comprising a diaphragm having a generally circular central portion of a predetermined thickness and a relatively thin lip circumscribing the central portion, the central portion having a convexly arcuate upper surface and a generally planar lower surface, the lip having generally planar upper and lower surfaces, the central portion closely received within said second aperture, the lip closely received between said second perimeter and the first, second, third and fourth side walls.

7. The column base of claim 6, further comprising a cap, the cap comprising:

opposed first and second lateral faces and opposed third and fourth lateral faces orthogonal to the first and second faces, each contiguous pair of mutually orthogonal faces rigidly attached along a common edge, each face having generally parallel top and bottom edges, each contiguous pair of bottom edges determining a bottom corner edge; and a top face having four mutually orthogonal, independently flexible web portions, each web portion rigidly attached along the top edge of a lateral face, the web portions determining an aperture through which the wood column is closely and slidably received, the stanchion side walls closely received interior to the cap lateral faces when the cap is slid downwardly until the cap lateral face bottom edges are at a common predetermined distance from said concrete line.

8. The column base of claim 7, further comprising:

means for stiffening the side walls against transverse loads;

means for stiffening the base portion against up-loads and down-loads;

means for minimizing moisture seepage into the base portion;

means for draining water accumulated above the diaphragm; and means for protecting the lowermost portion of the wood column from moisture, heat, fungus, and wood parasites.

9. The column base of claim 8, wherein said means for stiffening the side walls comprises:

opposed first and second gussets of a common predetermined length and width, each gusset determined by generally planar exterior and interior surfaces bounded by an upper edge of a first predetermined thickness and a lower edge of a second predetermined thickness less than said first thickness, each upper edge coinciding, respectively, with the upper end of the first and second side wall upper portions, each gusset interior surface rigidly attached, respectively, to the exterior surface of the upper portion of the first and second side walls, each gusset exterior surface generally orthogonal to the flange, the combined thickness along the length of each gusset and attached side wall upper portion being about constant and about equal to said predetermined thickness of the side wall lower end; and at least one shim interposed between a side wall upper portion and the wood column.

10. The column base of claim 8, wherein:

said means for stiffening the base portion comprises said flange aperture and said base portion cavity being filled with poured concrete up to a level of said second aperture less said thickness of the diaphragm central portion;

said means for minimizing moisture seepage comprises the diaphragm central portion inserted within said second aperture and resting on said concrete so that the weight carried by the wood column compresses the diaphragm lip against said upper surface peripheral region;

said means for draining water comprises first, second, third, and fourth apertures each determined by a separation between one of said troughs and a cap face bottom corner edge;

said means for protecting the lowermost portion of the wood column comprises immersion of the base portion in concrete to a depth such that the concrete surface exterior to the base portion is at said concrete line, and each cap face bottom corner edge is at said separation from the proximate trough; and said means for protecting the lowermost portion of the wood column further comprises said web portions in pressing contact with the wood column.

11. A column base for housing and supporting the lowermost portion of a wood column with a generally square cross-section of a predetermined size, the column base comprising a stanchion, the stanchion comprising:

a solid base portion determined by opposed, generally vertical, generally planar first and second faces and opposed, generally vertical, generally planar third and fourth faces, the third and fourth faces each generally orthogonal to the first and second faces, each pair of mutually orthogonal faces contiguous along a common, generally vertical edge, each face having generally horizontal lower and upper edges, the base portion further determined by a lower surface bounded by the face lower edges and by an upper surface bounded by the face upper edges, the lower surface having an aperture determined by a generally square perimeter with radiused vertices, the upper surface having an aperture determined by a generally circular perimeter, the base portion having therethrough a symmetrically disposed cavity tapering inwardly from the square aperture to the circular aperture, the square perimeter and face lower edges bounding a generally planar lower surface peripheral region, the circular perimeter and face upper edges bounding an upper surface peripheral region, each pair of mutually orthogonal upper edges determining a radiused corner, a portion of the upper surface peripheral region proximate to each corner having an elliptically-shaped trough beveled outwardly at a predetermined downward angle, portions of the upper surface peripheral region disposed exterior to the troughs being generally planar, the faces circumscribed by a generally horizontal concrete line at a predetermined distance below the base portion upper surface;

a generally circular flange having opposed, generally planar upper and lower surfaces generally orthogonal to the base portion faces, the flange having therethrough a generally square aperture determined by a perimeter generally congruent to the perimeter of the aperture in the base portion lower surface, the flange upper surface rigidly attached to the lower surface peripheral region of the base portion, the flange lower surface a predetermined distance below said concrete line;

opposed first and second generally vertical side walls, each side wall having a lower end of a first predetermined thickness rigidly attached and generally orthogonal to a planar portion of the upper surface peripheral region, each side wall having an upper portion terminating in an upper end of a second predetermined thickness, each upper portion having a generally planar exterior surface, each side wall of a thickness tapering decreasingly from the lower end thickness to the upper end thickness; and opposed third and fourth generally vertical side walls, each side wall having a lower end of the first predetermined thickness rigidly attached and generally orthogonal to a planar portion of the upper surface peripheral region, each side wall having an upper portion terminating in an upper end of the second predetermined thickness, each side wall of a thickness tapering decreasingly from the lower end thickness to the upper end thickness, the third and fourth side walls each generally orthogonal to the first and second side walls, the lower ends of each pair of adjacent side walls separated by a gap of a predetermined width, each gap and upper surface peripheral region proximate to the gap determining one of said troughs.

12. The column base of claim 11, further comprising a diaphragm having a generally circular central portion of a predetermined diameter and a predetermined thickness, and a relatively thin annular lip of a predetermined outer diameter, the central portion having a convexly arcuate upper surface and a generally planar lower surface, the lip having generally planar upper and lower surfaces, the central portion diameter such that the central portion is closely received within the circular aperture in the base portion upper surface, the lip outer diameter such that the lip is closely received between the circumferential perimeter determining said aperture and the first, second, third and fourth side walls.

13. The column base of claim 12, further comprising a cap, the cap comprising:

opposed first and second lateral faces and opposed third and fourth lateral faces orthogonal to the first and second faces, each contiguous pair of mutually orthogonal faces rigidly attached along a common edge, each face having generally parallel top and bottom edges, each contiguous pair of bottom edges determining a bottom corner edge; and a top face having four mutually orthogonal, independently flexible web portions, each web portion rigidly attached along the top edge of a lateral face, the web portions determining a generally square aperture through which the wood column is closely and slidably received, the stanchion side walls closely received interior to the cap lateral faces when the cap is slid downwardly until the cap lateral face bottom edges are at a common predetermined distance from said concrete line.

14. The column base of claim 13, further comprising:

means for stiffening the side walls against transverse loads;

means for stiffening the base portion against up-loads and down-loads;

means for minimizing moisture seepage into the base portion;

means for draining water accumulated above the diaphragm; and means for protecting the lowermost portion of the wood column from moisture, heat, fungus, and wood parasites.

15. The column base of claim 14, wherein:

said means for stiffening the side walls comprises opposed first and second gussets of a common predetermined length and width, each gusset determined by generally planar exterior and interior surfaces bounded by an upper edge of a first predetermined thickness and a lower edge of a second predetermined thickness less than said first thickness, each upper edge coinciding, respectively, with the upper end of the first and second side wall upper portions, each gusset interior surface rigidly attached, respectively, to the exterior surface of the upper portion of the first and second side walls, each gusset exterior surface generally orthogonal to the flange, the combined thickness along the length of each gusset and attached side wall upper portion being about constant and about equal to said predetermined thickness of the side wall lower end;

said means for stiffening the side walls further comprises least one shim interposed between a side wall upper portion and the wood column;

said means for stiffening the base portion comprises said flange aperture and said base portion cavity being filled with poured concrete up to a level of said circular aperture less said thickness of the diaphragm central portion;

said means for minimizing moisture seepage comprises the diaphragm central portion inserted within said circular aperture and resting on said concrete so that the weight carried by the wood column compresses the diaphragm lip against said upper surface peripheral region;

said means for draining water comprises first, second, third, and fourth apertures each determined by a separation between one of said beveled troughs and a cap face bottom corner edge;

said means for protecting the lowermost portion of the wood column comprises immersion of the base portion in concrete to a depth such that the concrete surface exterior to the base portion is at said concrete line, and each cap face bottom corner edge is at said separation from the proximate trough; and said means for protecting the lowermost portion of the wood column further comprises said web portions in pressing contact with the wood column.

16. The column base of claim 15, wherein the base portion, flange, side walls, and gussets are monolithically molded from a thermoplastic, and the diaphragm and cap are molded from a thermoplastic.

17. The column base of claim 15, wherein said predetermined size of the wood column cross-section is nominally 6 inches×6 inches.

18. The column base of claim 15, wherein said predetermined size of the wood column cross-section is nominally 8 inches×8 inches.

19. A column base for housing and supporting the lowermost portion of a wood column with a generally square cross-section of a predetermined size, the column base comprising a stanchion, the stanchion comprising:

a solid base portion determined by opposed, generally vertical, generally planar first and second faces and opposed, generally vertical, generally planar third and fourth faces, the third and fourth faces each generally orthogonal to the first and second faces, each pair of mutually orthogonal faces contiguous along a common, generally vertical edge, each face having generally horizontal lower and upper edges, the base portion further determined by a lower surface bounded by the face lower edges and by an upper surface bounded by the face upper edges, the lower surface having an aperture determined by a generally square perimeter with radiused vertices, the upper surface having an aperture determined by a generally circular perimeter, the base portion having therethrough a symmetrically disposed cavity tapering inwardly from the square aperture to the circular aperture, the square perimeter and face lower edges bounding a generally planar lower surface peripheral region, the circular perimeter and face upper edges bounding an upper surface peripheral region, each pair of mutually orthogonal upper edges determining a radiused corner, a portion of the upper surface peripheral region proximate to each corner having an elliptically-shaped trough beveled outwardly at a predetermined downward angle, portions of the upper surface peripheral region disposed exterior to the troughs being generally planar, the faces circumscribed by a generally horizontal concrete line at a predetermined distance below the base portion upper surface;

a generally circular flange having opposed, generally planar upper and lower surfaces generally orthogonal to the base portion faces, the flange having a circumferential outer portion with a plurality of holes therethrough and bounded by a circumferential edge, the flange outer portion having opposed U-shaped first and second knock-out shims of a first common thickness and opposed U-shaped third and fourth knock-out shims of a second common thickness, each shim having opposed first and second generally parallel legs rigidly attached to a base and separated by a gap, the base and gap determining a slot open at the circumferential edge, the shims disposed between adjacent pairs of said holes, the flange further having therethrough a generally square aperture determined by a perimeter generally congruent to the perimeter of the aperture in the base portion lower surface, the flange upper surface rigidly attached to the lower surface peripheral region of the base portion, the flange lower surface a predetermined distance below said concrete line;

opposed first and second generally vertical side walls, each side wall having a lower end of a first predetermined thickness rigidly attached and generally orthogonal to a planar portion of the upper surface peripheral region, the side wall lower ends radiused into said planar portions, each side wall having an upper portion terminating in an upper end of a second predetermined thickness, each upper portion having a generally planar exterior surface, each side wall of a thickness tapering decreasingly from the lower end thickness to the upper end thickness;

opposed third and fourth generally vertical side walls, each side wall having a lower end of the first predetermined thickness rigidly attached and generally orthogonal to a planar portion of the upper surface peripheral region, the side wall lower ends radiused into said planar portions, each side wall having an upper portion terminating in an upper end of the second predetermined thickness, each side wall of a thickness tapering decreasingly from the lower end thickness to the upper end thickness, the third and fourth side walls each generally orthogonal to the first and second side walls, the lower ends of each pair of adjacent side walls separated by a gap of a predetermined width, each gap and upper surface peripheral region proximate to the gap determining one of said troughs; and opposed first and second gussets of a common predetermined length and width, each gusset determined by generally planar exterior and interior surfaces bounded by an upper edge of a first predetermined thickness and a lower edge of a second predetermined thickness less than said first thickness, each upper edge coinciding, respectively, with the upper end of the first and second side wall upper portions, each gusset interior surface rigidly attached, respectively, to the exterior surface of the upper portion of the first and second side walls, each gusset exterior surface generally orthogonal to the flange, the combined thickness along the length of each gusset and attached side wall upper portion being about constant and about equal to said predetermined thickness of the side wall lower end.

20. The column base of claim 19, further comprising a diaphragm having a generally circular central portion of a predetermined diameter and a predetermined thickness, and a relatively thin annular lip of a predetermined outer diameter, the central portion having a convexly arcuate upper surface and a generally planar lower surface, the lip having generally planar upper and lower surfaces, the central portion diameter such that the central portion is closely received within the circular aperture in the base portion upper surface, the lip outer diameter such that the lip is closely received between the circumferential perimeter determining said aperture and the first, second, third, and fourth side walls.

21. The column base of claim 20, further comprising a cap, the cap comprising:

opposed, generally planar, generally rectangular first and second lateral faces and opposed, generally planar, generally rectangular third and fourth lateral faces orthogonal to the first and second faces, each face of a common thickness, the first and second faces having, respectively, first and second interior surfaces, each contiguous pair of mutually orthogonal faces rigidly attached along a common generally vertical edge, each face having generally parallel top and bottom edges, each contiguous pair of bottom edges determining a bottom corner edge, the first and second faces having, respectively, first and second generally vertical grooves in said first and second interior surfaces extending between the top and bottom edges, the first and second faces further having, respectively, opposed first and second slots of a first length, said first length determined by first and second arcuate slot ends distal, respectively, to the bottom edges of the first and second faces, the slots symmetrically disposed, respectively, within said grooves, the third and fourth faces having, respectively, opposed third and fourth slots of a second length shorter than said first length, the second length determined by third and fourth arcuate slot ends distal, respectively, to the bottom edges of the third and fourth faces; and a generally square top face having four mutually orthogonal, independently flexible web portions, the web portions determining a generally square aperture through which the wood column is closely and slidably received, each web portion tapering from a relatively thick end rigidly attached along the top edge of a lateral face to a relatively thin end in pressing contact with the wood column, the stanchion side walls closely received interior to the cap lateral faces and the gussets closely received within the grooves when the cap is slid downwardly to a stop position, the stop position determined when said first and second arcuate slot ends contact a first transverse bolt through the upper portion of the first side wall, the wood column lowermost portion, and the upper portion of the second side wall, the first bolt inserted through the side walls at a first predetermined distance below the side wall upper ends, and said third and fourth arcuate slot ends contact a second transverse bolt through the third side wall, the wood column lowermost portion, and the fourth side wall, the second bolt inserted through the side walls at a predetermined distance below the side wall upper ends, the stop position determining a predetermined distance between each cap lateral face bottom edge and said concrete line.

22. The column base of claim 21, wherein the base portion, flange, side walls and gussets are monolithically molded from a thermoplastic, and the diaphragm and cap are molded from a thermoplastic.

23. The column base of claim 22, wherein said predetermined size of the wood column cross-section is nominally 6 inches×6 inches.

24. The column base of claim 22, wherein said predetermined size of the wood column cross-section is nominally 8 inches×8 inches.

25. A column base for housing and supporting the lowermost portion of a wood column with a generally square cross-section of a predetermined size, the column base comprising a stanchion, the stanchion comprising:

a solid base portion determined by opposed, generally vertical, generally planar first and second faces and opposed, generally vertical, generally planar third and fourth faces, the third and fourth faces each generally orthogonal to the first and second faces, each pair of mutually orthogonal faces contiguous along a common, generally vertical edge, each face having generally horizontal lower and upper edges, the base portion further determined by a lower surface bounded by the face lower edges and by an upper surface bounded by the face upper edges, the lower surface having an aperture determined by a generally square perimeter with radiused vertices, the upper surface having an aperture determined by a generally circular perimeter, the base portion having therethrough a symmetrically disposed cavity tapering inwardly from the square aperture to the circular aperture, the square perimeter and face lower edges bounding a generally planar lower surface peripheral region, the circular perimeter and face upper edges bounding an upper surface peripheral region, each pair of mutually orthogonal upper edges determining a radiused corner, a portion of the upper surface peripheral region proximate to each corner having an elliptically-shaped trough beveled outwardly at a predetermined downward angle, portions of the upper surface peripheral region disposed exterior to the troughs being generally planar, the faces circumscribed by a generally horizontal concrete line at a predetermined distance below the base portion upper surface;

a generally circular flange having opposed, generally planar upper and lower surfaces generally orthogonal to the base portion faces, the flange having a circumferential outer portion with a plurality of holes and bounded by a circumferential edge, the flange having therethrough a generally square aperture determined by a perimeter generally congruent to the perimeter of the aperture in the base portion lower surface, the flange upper surface rigidly attached to the lower surface peripheral region of the base portion, the flange lower surface a predetermined distance below said concrete line;

opposed first and second generally vertical side walls, each side wall having a lower end of a first predetermined thickness rigidly attached and generally orthogonal to a planar portion of the upper surface peripheral region, the side wall lower ends radiused into said planar portions, each side wall having an upper portion terminating in an upper end of a second predetermined thickness, each side wall of a thickness tapering decreasingly from the lower end thickness to the upper end thickness; and opposed third and fourth generally vertical side walls, each side wall having a lower end of the first predetermined thickness rigidly attached and generally orthogonal to a planar portion of the upper surface peripheral region, the side wall lower ends radiused into said planar portions, each side wall having an upper portion terminating in an upper end of the second predetermined thickness, each side wall of a thickness tapering decreasingly from the lower end thickness to the upper end thickness, the third and fourth side walls each generally orthogonal to the first and second side walls, the lower ends of each pair of adjacent side walls separated by a gap of a predetermined width, each gap and upper surface peripheral region proximate to the gap determining one of said troughs.

26. The column base of claim 25, further comprising a diaphragm having a generally circular central portion of a predetermined diameter and a predetermined thickness, and a relatively thin annular lip of a predetermined outer diameter, the central portion having a convexly arcuate upper surface and a generally planar lower surface, the lip having generally planar upper and lower surfaces, the central portion diameter such that the central portion is closely received within the circular aperture in the base portion upper surface, the lip outer diameter such that the lip is closely received between the circumferential perimeter determining said aperture and the first, second, third, and fourth side walls.

27. The column base of claim 26, further comprising a cap, the cap comprising:

opposed, generally planar, generally rectangular first and second lateral faces and opposed, generally planar, generally rectangular third and fourth lateral faces orthogonal to the first and second faces, each face of a common thickness, each contiguous pair of mutually orthogonal faces rigidly attached along a common generally vertical edge, each face having generally parallel top and bottom edges, each contiguous pair of bottom edges determining a bottom corner edge, the first and second faces having, respectively, opposed first and second slots of a first length, said first length determined by first and second arcuate slot ends distal, respectively, to the bottom edges of the first and second faces, the third and fourth faces having, respectively, opposed third and fourth slots of a second length shorter than said first length, the second length determined by third and fourth arcuate slot ends distal, respectively, to the bottom edges of the third and fourth faces; and a generally square top face having four mutually orthogonal, independently flexible web portions, the web portions determining a generally square aperture through which the wood column is closely and slidably received, each web portion tapering from a relatively thick end rigidly attached along the top edge of a lateral face to a relatively thin end in pressing contact with the wood column, the stanchion side walls closely received interior to the cap lateral faces when the cap is slid downwardly to a stop position, the stop position determined when said first and second arcuate slot ends contact a first transverse bolt through the upper portion of the first side wall, the wood column lowermost portion, and the upper portion of the second side wall, the first bolt inserted through the side walls at a first predetermined distance below the side wall upper ends, and said third and fourth arcuate slot ends contact a second transverse bolt through the third side wall, the wood column lowermost portion, and the fourth side wall, the second bolt inserted through the side walls at a predetermined distance below the side wall upper ends, the stop position determining a predetermined distance between each cap lateral face bottom edge and said concrete line.

28. The column base of claim 27, wherein the base portion, flange and side walls are monolithically molded from a thermoplastic, and the diaphragm and cap are molded from a thermoplastic.

29. The column base of claim 28, wherein said predetermined size of the wood column cross-section is nominally 4 inches×4 inches.

* * * * *